US011703780B2

(12) United States Patent
Seshita et al.

(10) Patent No.: US 11,703,780 B2
(45) Date of Patent: Jul. 18, 2023

(54) HEATING DEVICE AND IMAGE FORMING APPARATUS

(71) Applicants: Takuya Seshita, Kanagawa (JP); Yuusuke Furuichi, Kanagawa (JP)

(72) Inventors: Takuya Seshita, Kanagawa (JP); Yuusuke Furuichi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/536,119

(22) Filed: Nov. 29, 2021

(65) Prior Publication Data

US 2022/0179338 A1 Jun. 9, 2022

(30) Foreign Application Priority Data

Dec. 4, 2020 (JP) ..... 2020-201772

(51) Int. Cl.
*G03G 15/20* (2006.01)

(52) U.S. Cl.
CPC ..... *G03G 15/2039* (2013.01); *G03G 15/2042* (2013.01); *G03G 15/2053* (2013.01); *G03G 2215/2035* (2013.01)

(58) Field of Classification Search
CPC ..... G03G 15/2039; G03G 15/2053; G03G 15/2042; G03G 15/2046; G03G 2215/2035; G03G 2215/2038; H05B 1/0241; H05B 3/0066
USPC ..... 399/69, 329, 334; 219/216
See application file for complete search history.

(56) References Cited

U.S. PATENT DOCUMENTS

| | | | | |
|---|---|---|---|---|
| 9,874,838 | B1 * | 1/2018 | Cao | G03G 15/2042 |
| 2005/0185977 | A1 * | 8/2005 | Kamei | G03G 15/2042 399/69 |
| 2006/0086730 | A1 * | 4/2006 | Kondo | G03G 15/2053 219/645 |
| 2007/0134018 | A1 * | 6/2007 | Nanba | G03G 15/2042 399/69 |

(Continued)

FOREIGN PATENT DOCUMENTS

| | | |
|---|---|---|
| JP | 6-250565 | 9/1994 |
| JP | 2007-163591 | 6/2007 |

(Continued)

*Primary Examiner* — Robert B Beatty
(74) *Attorney, Agent, or Firm* — Xsensus LLP

(57) ABSTRACT

A heating device includes a first temperature sensor and a second temperature sensor that detect a temperature of at least one of a first rotator, a second rotator, and a heater that heats at least one of the first rotator and the second rotator. The first temperature sensor is disposed outboard from an increased conveyance span where an increased size sheet having an increased width in a longitudinal direction of the heater is conveyed. The second temperature sensor is disposed outboard from a decreased conveyance span where a decreased size sheet having a decreased width in the longitudinal direction of the heater is conveyed. The decreased conveyance span is smaller than the increased conveyance span. The second temperature sensor is disposed within the increased conveyance span and disposed opposite the first temperature sensor via a center of the increased conveyance span in the longitudinal direction of the heater.

15 Claims, 13 Drawing Sheets

(56) References Cited

U.S. PATENT DOCUMENTS

| | | | | |
|---|---|---|---|---|
| 2012/0051766 | A1* | 3/2012 | Ueno | G03G 15/205 399/334 |
| 2013/0259507 | A1* | 10/2013 | Cao | G03G 15/2042 399/69 |
| 2015/0316879 | A1* | 11/2015 | Koyama | G03G 15/2017 399/69 |
| 2019/0086844 | A1* | 3/2019 | Hirota | G03G 21/206 |
| 2019/0086845 | A1* | 3/2019 | Hashiguchi | G03G 15/2039 |
| 2019/0121267 | A1* | 4/2019 | Miyauchi | G03G 15/2039 |
| 2019/0179242 | A1 | 6/2019 | Adachi et al. | |
| 2019/0196374 | A1 | 6/2019 | Adachi et al. | |
| 2020/0174407 | A1 | 6/2020 | Furuichi | |
| 2020/0174408 | A1* | 6/2020 | Furuichi | G03G 15/2042 |
| 2021/0278790 | A1 | 9/2021 | Furuichi et al. | |

FOREIGN PATENT DOCUMENTS

| | | | | |
|---|---|---|---|---|
| JP | 4208749 | B2 * | 1/2009 | G03G 15/2039 |
| JP | 2012-198475 | | 10/2012 | |
| JP | 2020-052345 | | 4/2020 | |
| JP | 2020-086278 | | 6/2020 | |

* cited by examiner

HEATING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-201772, filed on Dec. 4, 2020, in the Japan Patent Office, the entire disclosure of which is hereby incorporated by reference herein.

BACKGROUND

Technical Field

Exemplary aspects of the present disclosure relate to a heating device and an image forming apparatus, and more particularly, to a heating device and an image forming apparatus incorporating the heating device.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data.

Such image forming apparatuses include, as a heating device, for example, a fixing device that fixes a toner image on a sheet under heat.

The fixing device includes a plurality of rotators, such as a roller and a belt, that sandwiches and heats the sheet, and a heater that heats at least one of the rotators. In order to retain the temperature of at least one of the rotators or the heater precisely, the fixing device further includes a temperature sensor that detects the temperature of at least one of the rotators or the heater.

SUMMARY

This specification describes below an improved heating device. In one embodiment, the heating device includes a first rotator and a second rotator that contacts the first rotator to form a nip between the first rotator and the second rotator. A heater heats at least one of the first rotator and the second rotator. A first temperature sensor detects a temperature of at least one of the first rotator, the second rotator, and the heater. The first temperature sensor is disposed outboard from an increased conveyance span in a longitudinal direction of the heater. An increased size sheet having an increased width in the longitudinal direction of the heater is conveyed through the nip in the increased conveyance span. A second temperature sensor detects the temperature of the at least one of the first rotator, the second rotator, and the heater. The second temperature sensor is disposed outboard from a decreased conveyance span in the longitudinal direction of the heater. A decreased size sheet having a decreased width in the longitudinal direction of the heater is conveyed through the nip in the decreased conveyance span. The decreased conveyance span is smaller than the increased conveyance span. The second temperature sensor is disposed within the increased conveyance span and disposed opposite the first temperature sensor via a center of the increased conveyance span in the longitudinal direction of the heater.

This specification further describes an improved image forming apparatus. In one embodiment, the image forming apparatus includes a conveying portion that conveys an increased size sheet and a decreased size sheet and the heating device described above that heats the increased size sheet and the decreased size sheet.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
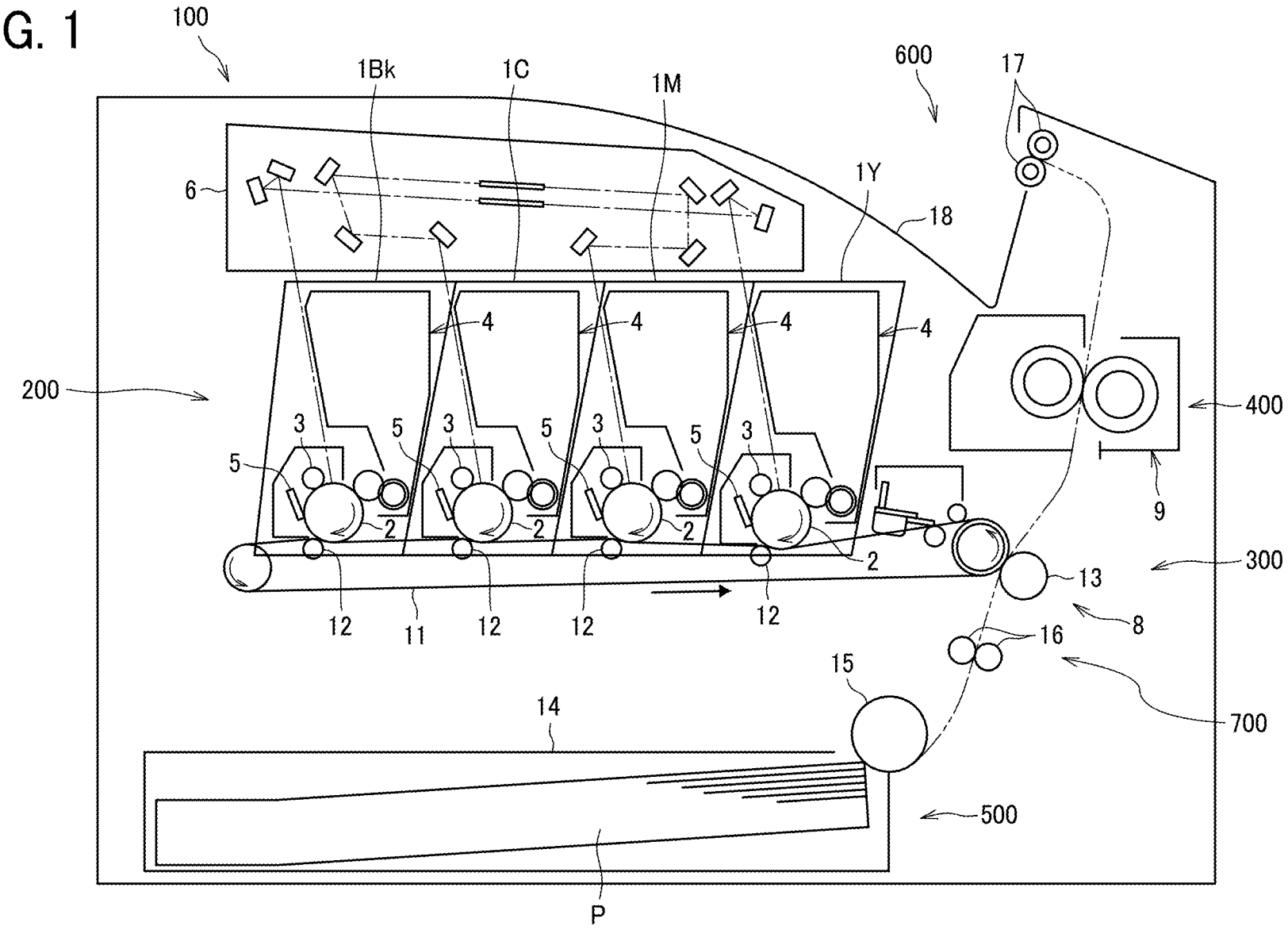
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to the attached drawings, the following describes embodiments of the present disclosure.

In the drawings for explaining the embodiments of the present disclosure, identical reference numerals are assigned to elements such as members and parts that have an identical function or an identical shape as long as differentiation is possible. Therefore, a description of those elements is omitted once the description is provided.

FIG. 1 is a schematic cross-sectional view of an image forming apparatus 100 according to an embodiment of the present disclosure.

As illustrated in FIG. 1, the image forming apparatus 100 includes an image forming portion 200, a transfer portion 300, a fixing portion 400, a recording medium supply portion 500, a recording medium ejecting portion 600, and a conveying portion 700.

The image forming portion 200 includes four process units 1Y, 1M, 1C, and 1Bk and an exposure device 6. Each of the process units 1Y, 1M, 1C, and 1Bk serves as an image forming unit that is removably installed in a body of the image forming apparatus 100. The process units 1Y, 1M, 1C, and 1Bk basically have a similar construction except that the process units 1Y, 1M, 1C, and 1Bk contain toners, serving as developers, in different colors, that is, yellow, magenta, cyan, and black, respectively, which correspond to color separation components for a color image. For example, each of the process units 1Y 1M, 1C, and 1Bk includes a photoconductor 2, a charger 3, a developing device 4, and a cleaner 5.

The photoconductor 2 serves as an image bearer that bears a toner image on a surface of the photoconductor 2. According to this embodiment, the photoconductor 2 is a photoconductor having a drum shape, that is, a photoconductive drum. Alternatively, the photoconductor 2 may be a photoconductor having a belt shape, that is, a photoconductive belt. The charger 3 charges the surface of the photoconductor 2. According to this embodiment, the charger 3 is a charging roller that contacts the surface of the photoconductor 2. The charger 3 is not limited to a contact type charger and may be a non-contact type charger using corona charging, for example. The developing device 4 supplies toner as a developer to the surface of the photoconductor 2 to form a visible image, that is, a toner image. The cleaner 5 removes residual toner and other foreign substance that remain on the surface of the photoconductor 2 therefrom. The cleaner 5 is a blade, a roller, or the like that contacts the surface of the photoconductor 2.

The transfer portion 300 includes a transfer device 8 that transfers the toner image onto a sheet P serving as a recording medium. The recording medium may be a sheet made of paper, such as plain paper, thick paper, thin paper, coated paper, a label sheet, and an envelope, or a sheet made of resin, such as an overhead projector (OHP) transparency. The transfer device 8 includes an intermediate transfer belt 11, four primary transfer rollers 12, and a secondary transfer roller 13. The intermediate transfer belt 11 is an endless belt stretched taut across a plurality of rollers. The primary transfer rollers 12 are pressed against the photoconductors 2, respectively, via the intermediate transfer belt 11. Thus, the intermediate transfer belt 11 contacts each of the photoconductors 2, forming a primary transfer nip therebetween. On the other hand, the secondary transfer roller 13 is pressed against one of the plurality of rollers across which the intermediate transfer belt 11 is stretched taut via the intermediate transfer belt 11. Thus, a secondary transfer nip is formed between the secondary transfer roller 13 and the intermediate transfer belt 11.

The fixing portion 400 includes a fixing device 9 that fixes the toner image on the sheet P. A construction of the fixing device 9 is described below in detail.

The recording medium supply portion 500 includes a sheet tray 14 and a feed roller 15. The sheet tray 14 loads a plurality of sheets P serving as recording media. The feed roller 15 picks up and feeds a sheet P from the sheet tray 14.

The recording medium ejecting portion 600 includes an output roller pair 17 and an output tray 18. The output roller pair 17 ejects the sheet P onto an outside of the image forming apparatus 100. The output tray 18 is placed with the sheet P ejected by the output roller pair 17. The conveying portion 700 includes a timing roller pair 16.

Referring to FIG. 1, a description is provided of printing processes performed by the image forming apparatus 100 according to this embodiment.

When the image forming apparatus 100 receives an instruction to start printing, a driver starts driving and rotating the photoconductor 2 of each of the process units 1Y, 1M, 1C, and 1Bk clockwise in FIG. 1 and the intermediate transfer belt 11 counterclockwise in FIG. 1. The feed roller 15 starts rotation, feeding a sheet P from the sheet tray 14. As the sheet P fed by the feed roller 15 comes into contact with the timing roller pair 16, the timing roller pair 16 temporarily halts the sheet P.

The charger 3 of each of the process units 1Y, 1M, 1C, and 1Bk charges the surface of the photoconductor 2 uniformly at a high electric potential. According to image data created by an original scanner that reads an image on an original or print data instructed by a terminal, the exposure device 6 exposes the surface of each of the photoconductors 2. Accordingly, the electric potential of an exposed portion on the surface of each of the photoconductors 2 decreases, forming an electrostatic latent image on the surface of each of the photoconductors 2. The developing device 4 of each of the process units 1Y, 1M, 1C, and 1Bk supplies toner to the electrostatic latent image formed on the photoconductor 2, forming a toner image thereon. When the toner images formed on the photoconductors 2 reach the primary transfer nips defined by the primary transfer rollers 12 in accordance with rotation of the photoconductors 2, respectively, the toner images formed on the photoconductors 2 are transferred onto the intermediate transfer belt 11 driven and rotated counterclockwise in FIG. 1 successively such that the toner images are superimposed on the intermediate transfer belt 11. Thus, a full color toner image is formed on the intermediate transfer belt 11. Alternatively, one of the four process units 1Y, 1M, 1C, and 1Bk may be used to form a monochrome toner image or two or three of the four process units 1Y, 1M, 1C, and 1Bk may be used to form a bicolor toner image or a tricolor toner image. After the toner image formed on the photoconductor 2 is transferred onto the intermediate transfer belt 11, the cleaner 5 removes residual toner and the like remaining on the photoconductor 2 therefrom. Thus, the photoconductor 2 is ready for formation of a next electrostatic latent image.

The full color toner image formed on the intermediate transfer belt 11 is conveyed to the secondary transfer nip defined by the secondary transfer roller 13 in accordance with rotation of the intermediate transfer belt 11 and is transferred onto the sheet P conveyed by the timing roller pair 16. The sheet P transferred with the full color toner image is conveyed to the fixing device 9 that fixes the full color toner image on the sheet P. Thereafter, the output roller pair 17 ejects the sheet P onto the output tray 18, thus finishing a series of printing processes.

A description is provided of a construction of the fixing device 9 according to this embodiment.

Figure 2:
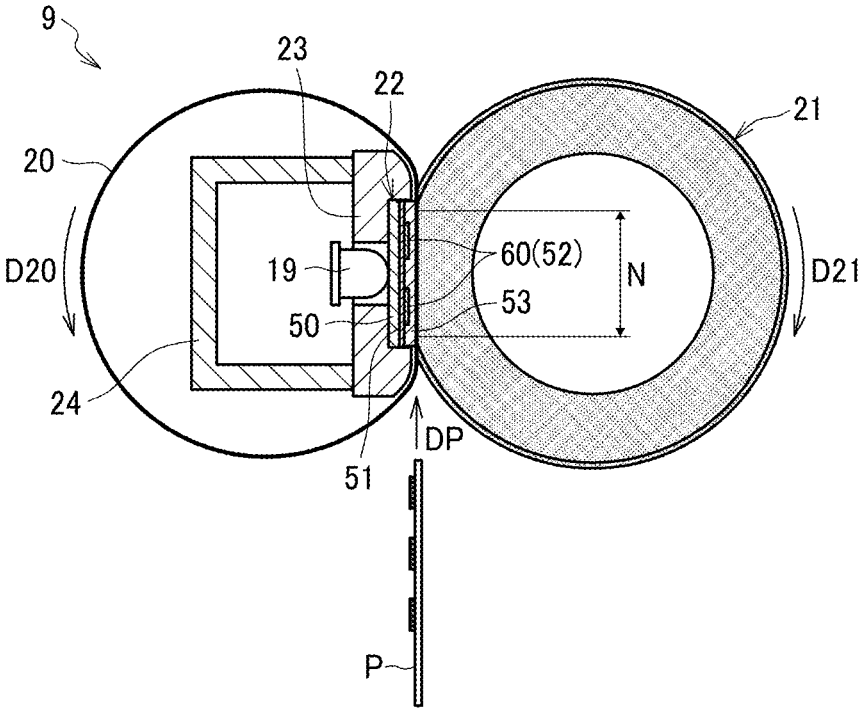
FIG. 2 is a schematic cross-sectional view of a fixing device incorporated in the image forming apparatus depicted in FIG. 1.

As illustrated in FIG. 2, the fixing device 9 according to this embodiment includes a fixing belt 20, a pressure roller 21, a heater 22, a heater holder 23, a stay 24, and a temperature sensor 19.

The fixing belt 20 is disposed opposite an unfixed toner image bearing side (e.g., an imaging side) of a sheet P, that bears an unfixed toner image. The fixing belt 20 is a rotator, that is, a first rotator, serving as a fixing rotator that fixes the unfixed toner image on the sheet P. A pair of belt supports is inserted into a loop formed by the fixing belt 20 at both lateral ends of the fixing belt 20 in an axial direction thereof, respectively. The belt supports support the fixing belt 20 in a state in which the fixing belt 20 is not applied with tension at least while the fixing belt 20 does not rotate, that is, by a free belt system. The fixing belt 20 includes a base layer made of polyimide (PI), for example. Alternatively, the base layer may be made of heat-resistant resin such as polyether ether ketone (PEEK) or metal such as nickel (Ni) and stainless used steel (SUS), instead of polyimide. In order to enhance durability of the fixing belt 20 and facilitate separation of toner of the toner image on the sheet P from the fixing belt 20, a release layer made of fluororesin such as perfluoroalkoxy alkane (PFA) and polytetrafluoroethylene (PTFE) may be disposed on an outer circumferential surface of the base layer. Further, an elastic layer that is made of rubber or the like may be interposed between the base layer and the release layer. An inner circumferential surface of the base layer may be coated with a slide layer made of polyimide, PTFE, or the like.

The pressure roller 21 is another rotator, that is, a second rotator, that is separately provided from the fixing belt 20. The pressure roller 21 serves as an opposed rotator that is disposed opposite an outer circumferential surface of the fixing belt 20. The pressure roller 21 includes a core metal made of metal, an elastic layer, and a release layer. The elastic layer is disposed on an outer circumferential surface of the core metal and is made of silicone rubber or the like. The release layer is disposed on an outer circumferential surface of the elastic layer and is made of fluororesin or the like.

A spring serving as a biasing member causes the fixing belt 20 and the pressure roller 21 to press against and contact with each other. Thus, a fixing nip N is formed between the fixing belt 20 and the pressure roller 21. A driving force is transmitted to the pressure roller 21 from a driver disposed inside the body of the image forming apparatus 100. Accordingly, as the driver drives and rotates the pressure roller 21, the driving force is transmitted from the pressure roller 21 to the fixing belt 20 at the fixing nip N, rotating the fixing belt 20 in accordance with rotation of the pressure roller 21. As illustrated in FIG. 2, as a sheet P bearing an unfixed toner image enters the fixing nip N formed between the fixing belt 20 and the pressure roller 21 that rotate in rotation directions D20 and D21, respectively, the fixing belt 20 and the pressure roller 21 heat and press the sheet P that is conveyed in a sheet conveyance direction DP. Thus, the fixing belt 20 and the pressure roller 21 fix the unfixed toner image on the sheet P.

The heater 22 heats the fixing belt 20. According to this embodiment, the heater 22 includes a base layer 50 that is platy, a first insulating layer 51 mounted on the base layer 50, a conductor layer 52 mounted on the first insulating layer 51, and a second insulating layer 53 coating the conductor layer 52. The conductor layer 52 includes resistive heat generators 60 that generate heat when the heater 22 is energized.

According to this embodiment, in order to enhance heating efficiency of the heater 22 that heats the fixing belt 20, the heater 22 contacts an inner circumferential surface of the fixing belt 20 directly. Alternatively, the heater 22 may not contact the fixing belt 20 or may be disposed opposite the fixing belt 20 indirectly via a low-friction sheet or the like. The heater 22 may contact the outer circumferential surface of the fixing belt 20. However, in this case, the heater 22 contacting the fixing belt 20 may damage the outer circumferential surface of the fixing belt 20, resulting in degradation of fixing quality. To address this circumstance, the heater 22 preferably contacts the inner circumferential surface of the fixing belt 20 rather than the outer circumferential surface of the fixing belt 20.

The heater holder 23 is disposed within the loop formed by the fixing belt 20 and holds the heater 22. Since the heater holder 23 is subject to a high temperature by heat from the heater 22, the heater holder 23 is preferably made of a heat-resistant material. For example, if the heater holder 23 is made of heat-resistant resin having a decreased thermal conductivity, such as liquid crystal polymer (LCP) and PEEK, while the heater holder 23 attains heat resistance, the heater holder 23 suppresses conduction of heat thereto from the heater 22, facilitating heating of the fixing belt 20.

The stay 24 is disposed within the loop formed by the fixing belt 20. The stay 24 serves as a support that supports the heater 22 and the heater holder 23. The stay 24 supports an opposite face of the heater holder 23, that is opposite a nip side face of the heater holder 23, that is disposed opposite the fixing nip N, thus preventing the heater holder 23 from being bent by pressure from the pressure roller 21. Thus, the fixing nip N, having an even length in the sheet conveyance direction DP throughout an entire span of the fixing belt 20 in the axial direction thereof, is formed between the fixing belt 20 and the pressure roller 21. The stay 24 is preferably made of ferrous metal such as stainless used steel (SUS) and steel electrolytic cold commercial (SECC) to achieve rigidity.

The temperature sensor 19 serves as a temperature detector that detects the temperature of the heater 22. The fixing device 9 according to this embodiment includes a plurality of temperature sensors 19. FIG. 2 illustrates one of the plurality of temperature sensors 19. General temperature sensors such as a thermopile, a thermostat, a thermistor, and a normally closed (NC) sensor are used as the temperature sensors 19. Each of the temperature sensors 19 may be a contact type temperature sensor that contacts the heater 22 or a non-contact type temperature sensor that is disposed opposite the heater 22 with a gap therebetween. According to this embodiment, the temperature sensor 19 contacts an opposite face of the heater 22, that is opposite a nip side face of the heater 22, that is disposed opposite the fixing nip N.

Figure 3:
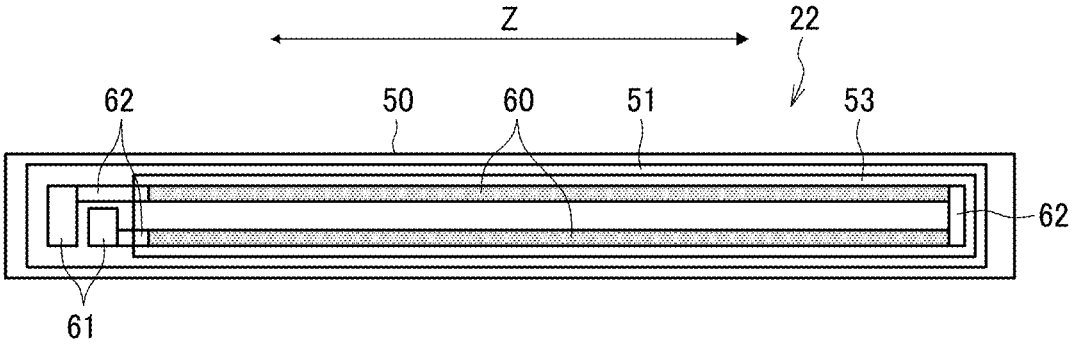
FIG. 3 is a plan view of a heater incorporated in the fixing device depicted in FIG. 2.
Figure 4:
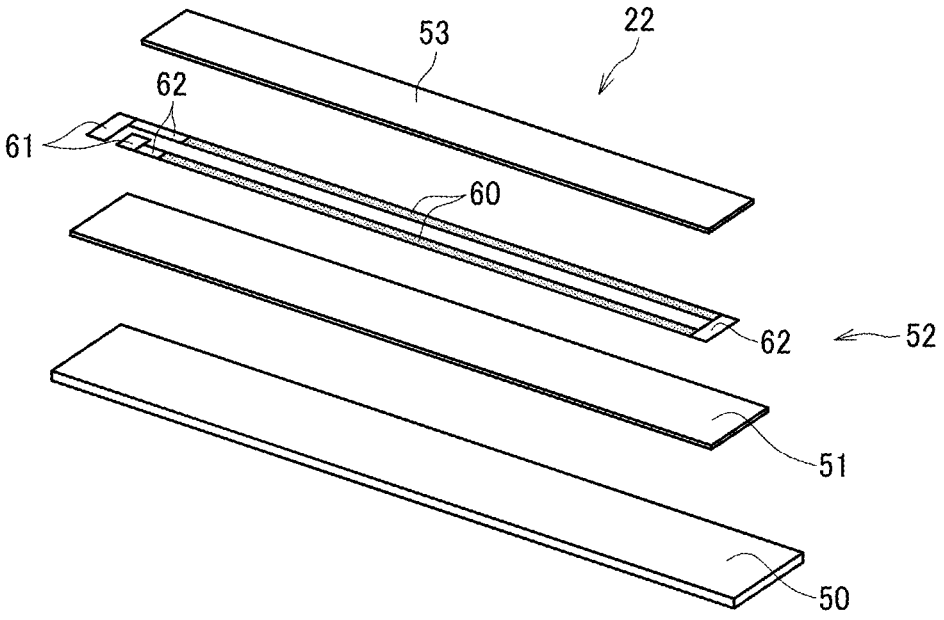
FIG. 4 is an exploded perspective view of the heater depicted in FIG. 3.

FIG. 3 is a plan view of the heater 22 according to this embodiment. FIG. 4 is an exploded perspective view of the heater 22.

As illustrated in FIGS. 3 and 4, the heater 22 includes the base layer 50 that is platy. The heater 22 is a laminated heater in which the base layer 50 mounts the first insulating layer 51 that mounts the conductor layer 52 that mounts the second insulating layer 53. As illustrated in FIG. 3, the base layer 50 extends in a longitudinal direction Z that is parallel to a longitudinal direction or an axial direction of the fixing belt 20 and the pressure roller 21.

The base layer 50 is made of metal such as stainless used steel (SUS), iron, and aluminum, for example. Instead of metal, the base layer 50 may be made of ceramics, glass, or the like. If the base layer 50 is made of an insulating material such as ceramics, the first insulating layer 51 sandwiched between the base layer 50 and the conductor layer 52 may be omitted. Since metal has an enhanced durability against rapid heating and is processed readily, metal is preferably used to reduce manufacturing costs of the heater 22. Among metals, aluminum and copper are preferable because aluminum and copper attain an enhanced thermal conductivity and barely suffer from uneven temperature. The base layer 50 made of stainless steel is manufactured at reduced costs compared to the base layer 50 made of aluminum or copper.

The conductor layer 52 includes electrodes 61 and feeders 62 (e.g., conductor portions) in addition to the resistive heat generators 60. Each of the resistive heat generators 60 extends in the longitudinal direction Z of the base layer 50. The two resistive heat generators 60 are arranged in line with each other in a direction perpendicular to the longitudinal direction Z. The resistive heat generators 60 are electrically connected to the two electrodes 61 through the plurality of feeders 62, respectively. The electrodes 61 are disposed on one lateral end (e.g., a left end in FIG. 3) of the base layer 50 in the longitudinal direction Z thereof. For example, one lateral end (e.g., a left end in FIG. 3) of one of the resistive heat generators 60 is electrically connected to one of the electrodes 61 through one of the feeders 62. One lateral end (e.g., the left end in FIG. 3) of another one of the resistive heat generators 60 is electrically connected to another one of the electrodes 61 through another one of the feeders 62. Another lateral end (e.g., a right end in FIG. 3) of one of the resistive heat generators 60 is electrically connected to another lateral end of another one of the resistive heat generators 60 through the feeder 62 disposed on another lateral end of the base layer 50 in the longitudinal direction Z thereof.

For example, each of the resistive heat generators 60 is produced as below. Silver-palladium (AgPd), glass powder, and the like are mixed into paste. The paste coats the base layer 50 by screen printing. Thereafter, the base layer 50 is subject to firing. Alternatively, each of the resistive heat generators 60 may be made of a resistive material such as a silver alloy (AgPt) and ruthenium oxide ($RuO_2$).

Each of the electrodes 61 and the feeders 62 is made of a conductor having a resistance value smaller than a resistance value of each of the resistive heat generators 60. For example, each of the electrodes 61 and the feeders 62 is produced by coating the base layer 50 with silver (Ag), silver-palladium (AgPd), or the like by screen printing.

As illustrated in FIG. 3, the second insulating layer 53 covers an entirety of each of the resistive heat generators 60 and at least a part of each of the feeders 62 to attain insulation. Conversely, since each of the electrodes 61 is connected to a connector serving as a feeding member described below, each of the electrodes 61 is not covered by the second insulating layer 53 and is exposed.

For example, each of the first insulating layer 51 and the second insulating layer 53 is made of an insulating material such as heat-resistant glass. Specifically, each of the first insulating layer 51 and the second insulating layer 53 is made of ceramics, polyimide, or the like. Optionally, a third insulating layer may be mounted on an opposite face of the base layer 50, that is opposite a nip side face of the base layer 50, that mounts the first insulating layer 51 and the second insulating layer 53.

According to this embodiment, since the resistive heat generators 60 are mounted on the nip side face of the base layer 50, heat generated by the resistive heat generators 60 is conducted to the fixing belt 20 without being conducted through the base layer 50, heating the fixing belt 20 effectively. Alternatively, the resistive heat generators 60 may be mounted on the opposite face of the base layer 50, that is opposite the nip side face of the base layer 50. However, in this case, heat generated by the resistive heat generators 60 is conducted to the fixing belt 20 through the base layer 50. Hence, the base layer 50 is preferably made of a material having an increased thermal conductivity, such as aluminum nitride.

Figure 5:
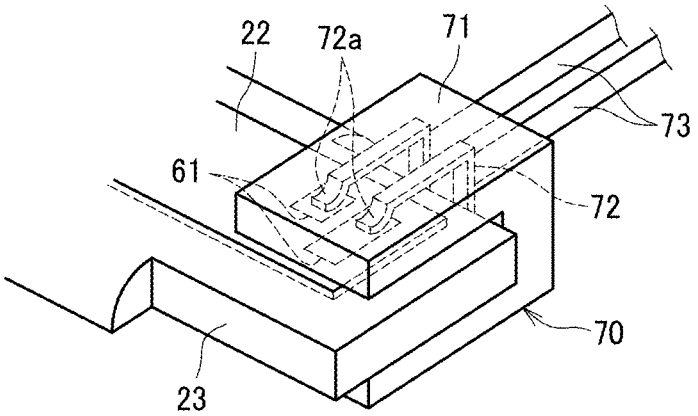
FIG. 5 is a perspective view of the heater depicted in FIG. 3 and a connector coupled thereto.

FIG. 5 is a perspective view of the heater 22 and a connector 70 coupled thereto.

As illustrated in FIG. 5, the connector 70 includes a housing 71 made of resin and a plurality of contact terminals 72. Each of the contact terminals 72 is a resilient member that has conductivity, such as a flat spring. The housing 71 accommodates the contact terminals 72. The contact terminals 72 are coupled to harnesses 73 that supply electricity, respectively.

As illustrated in FIG. 5, the connector 70 is attached to the heater 22 and the heater holder 23 such that the connector 70 sandwiches the heater 22 and the heater holder 23 together. Thus, the connector 70 supports the heater 22 and the heater holder 23. Each of the contact terminals 72 includes a contact 72*a* disposed at a tip of the contact terminal 72. As the contacts 72*a* resiliently contact or press against the electrodes 61, respectively, the contact terminals 72 are electrically connected to the electrodes 61, respectively. Accordingly, a power supply disposed inside the body of the image forming apparatus 100 supplies power to the resistive heat generators 60. Thus, as power is supplied to the resistive heat generators 60 through the connector 70, the resistive heat generators 60 generate heat.

A description is provided of a construction of a first comparative fixing device.

The first comparative fixing device may suffer from overheating in a non-conveyance span on a fixing belt (e.g., an endless film) where a sheet is not conveyed because the sheet does not draw heat from the non-conveyance span. To address this circumstance, a temperature sensor may be disposed opposite the non-conveyance span. For example, the temperature sensor detects the temperature of the non-conveyance span on a stay that guides the fixing belt. If the detected temperature exceeds a predetermined temperature, sheets are conveyed over the fixing belt with an interval, suppressing temperature increase in the non-conveyance span.

In addition to a disadvantage of overheating in the non-conveyance span described above, the first comparative fixing device may suffer from a disadvantage caused by shifting of a sheet from a proper position while the sheet is conveyed. For example, if the sheet is erroneously placed on a sheet tray, the sheet may be conveyed in a state in which the sheet is shifted from the proper position in a width direction perpendicular to a sheet conveyance direction. In this case, the sheet increases the non-conveyance span in one lateral end on the fixing belt in an axial direction thereof, that is opposite via the sheet to another lateral end where the sheet is shifted. The sheet draws less heat in the increased non-conveyance span, accelerating temperature increase. As a result, a difference in thermal expansion of a roller increases between the non-conveyance span and a conveyance span where the sheet is conveyed. Accordingly, a difference in rotation speed increases between the roller and the fixing belt that is in contact with the roller and is driven and rotated by the roller. Consequently, the fixing belt may twist and suffer from plastic deformation.

Figure 6:
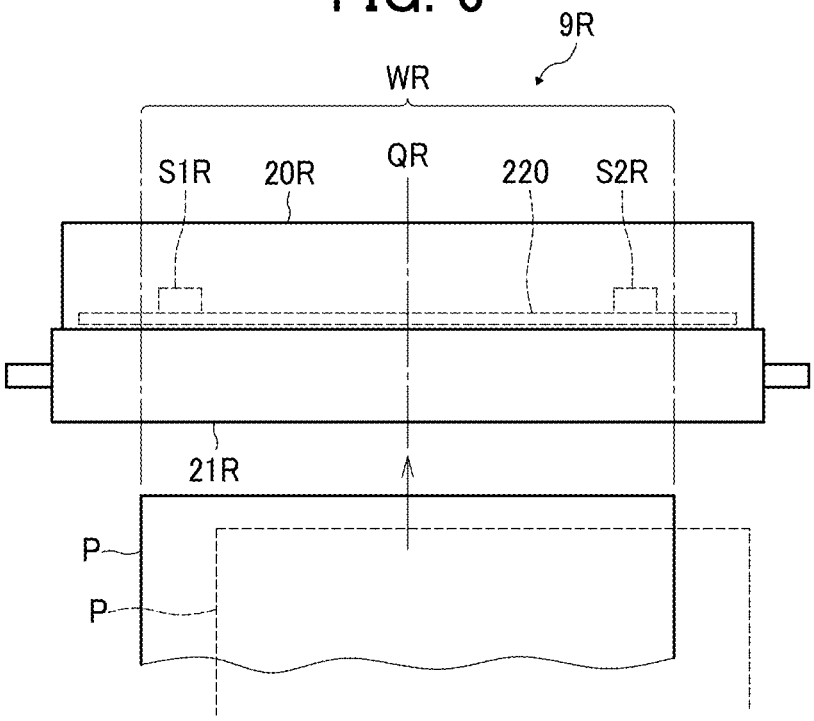
FIG. 6 is a diagram of a comparative fixing device, illustrating comparative temperature sensors that detect shifting of a sheet.

In order to prevent plastic deformation of the fixing belt caused by the shifted sheet, a second comparative fixing device 9R illustrated in FIG. 6 employs a method for determining whether or not the sheet is shifted based on temperatures detected by temperature sensors. For example, as illustrated in FIG. 6, the second comparative fixing device 9R includes a fixing belt 20R and a pressure roller 21R. Two temperature sensors SR1 and SR2 are disposed within a conveyance span WR where a sheet P is conveyed. The temperature sensor SR1 is symmetric with the temperature sensor SR2 with respect to a center QR, that is, a center line for conveyance of the sheet P. Each of the temperature sensors SR1 and SR2 detects the temperature of a heater 220. If the sheet P is conveyed without being shifted as indicated with a solid line in FIG. 6, an amount of heat drawn by the sheet P is equal in both spans defined by the center QR in a longitudinal direction of the heater 220. Accordingly, a temperature detected by the temperature sensor SR1 is equivalent to a temperature detected by the temperature sensor SR2. Conversely, if the sheet P is conveyed and shifted as indicated with a dotted line in FIG. 6, an amount of heat drawn by the sheet P is unequal in both spans defined by the center QR in the longitudinal direction of the heater 220. Accordingly, a temperature detected by the temperature sensor SR1 is substantially different from a temperature detected by the temperature sensor SR2. If the sheet P is shifted, a difference between the temperature detected by the temperature sensor SR1 and the temperature detected by the temperature sensor SR2 increases. To address this circumstance, the second comparative fixing device 9R determines the difference between the temperature detected by the temperature sensor SR1 and the temperature detected by the temperature sensor SR2 so as to determine whether or not the sheet P is shifted.

As described above, the first comparative fixing device and the second comparative fixing device 9R use the temperature sensors to overcome the disadvantage of temperature increase of the fixing belt in the non-conveyance span and the disadvantage of shifting of the sheet. However, the positions of the temperature sensors vary depending on the disadvantages. Hence, in order to overcome both the disadvantages, the number of the temperature sensors may increase, increasing manufacturing costs and upsizing the first comparative fixing device and the second comparative fixing device 9R.

As described above, the first comparative fixing device and the second comparative fixing device 9R suffer from the disadvantage of temperature increase in the non-conveyance span where the sheet is not conveyed over the fixing belt and the disadvantage of plastic deformation of the fixing belt caused by shifting of the sheet while the sheet is conveyed over the fixing belt. General configurations propose solution of one of those disadvantages but do not propose solution of both the disadvantages. If the general configurations are employed to overcome both the disadvantages, the general configurations may cause other disadvantages of increase in the number of the temperature sensors, increase in manufacturing costs, and upsizing of the first comparative fixing device and the second comparative fixing device 9R. To address this circumstance, the fixing device 9 according to this embodiment employs a configuration described below to overcome both the disadvantages with fewer temperature sensors.

A description is provided of an advantageous configuration of the fixing device 9.

Figure 7:
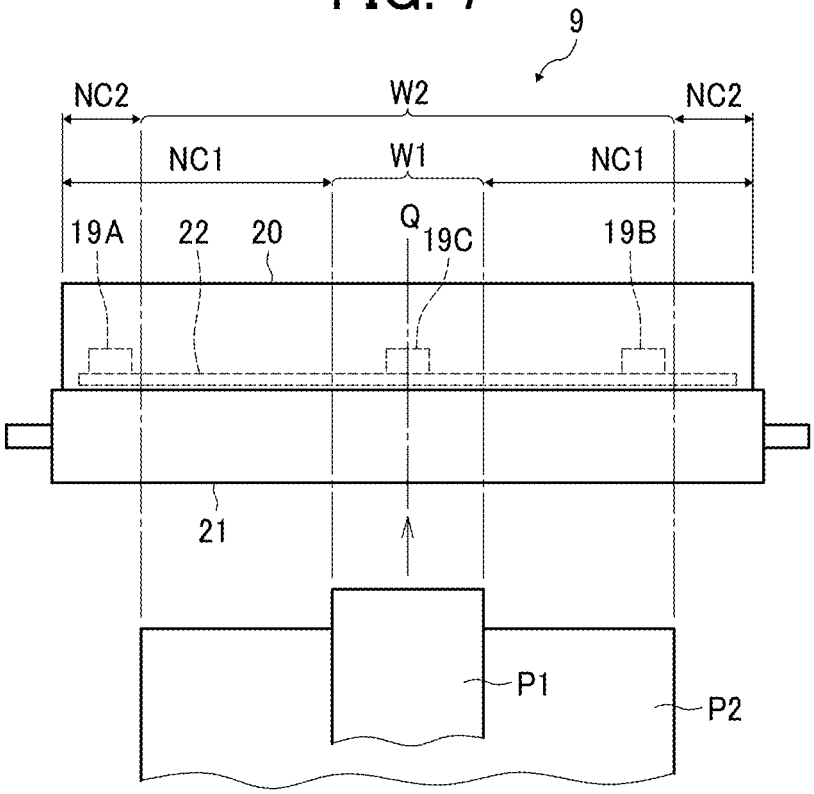
FIG. 7 is a schematic diagram of the fixing device depicted in FIG. 2 according to a first embodiment of the present disclosure.

FIG. 7 is a schematic diagram of the fixing device 9 according to a first embodiment of the present disclosure.

As illustrated in FIG. 7, the fixing device 9 according to the first embodiment includes three temperature sensors that detect the temperature of the heater 22. The three temperature sensors include a first temperature sensor 19A (e.g., a left temperature sensor in FIG. 7), a second temperature sensor 19B (e.g., a right temperature sensor in FIG. 7), and a third temperature sensor 19C (e.g., a center temperature sensor in FIG. 7). The third temperature sensor 19C disposed opposite a center span of the heater 22 in a longitudinal direction thereof is mainly used to control the temperature of the fixing belt 20. For example, a controller 30 illustrated in FIG. 8 controls a heat generation amount of the heater 22 based on a temperature of the heater 22, that is detected by the third temperature sensor 19C, thus retaining a predetermined target temperature of the fixing belt 20. The third temperature sensor 19C is disposed within a minimum conveyance span W1 where a minimum size sheet P1 is conveyed so that the third temperature sensor 19C detects the temperature of the heater 22 in a plurality of conveyance spans where sheets having different widths, respectively, are conveyed. The minimum conveyance span W1 defines a conveyance span where the minimum size sheet P1, that has a minimum width in a width direction of the minimum size sheet P1 and is conveyable in the image forming apparatus 100, is conveyed. The width direction is parallel to the longitudinal direction of the heater 22 and the axial direction of the fixing belt 20 and the pressure roller 21. The conveyance span defines a span that extends in a direction that is parallel to a surface of a sheet (e.g., a paper surface) and perpendicular to the sheet conveyance direction DP.

The first temperature sensor 19A disposed on the left of the third temperature sensor 19C in FIG. 7 and the second temperature sensor 19B disposed on the right of the third temperature sensor 19C in FIG. 7 are used to detect temperature increase in non-conveyance spans NC2 and NC1 where a maximum size sheet P2 and the minimum size sheet P1, respectively, are not conveyed and to detect shifting of the maximum size sheet P2 and the minimum size sheet P1. For example, the first temperature sensor 19A and the second temperature sensor 19B are disposed outboard from the minimum conveyance span W1 in the longitudinal direction of the heater 22. The first temperature sensor 19A is disposed outboard from a maximum conveyance span W2 where the maximum size sheet P2, that has a maximum width in a width direction of the maximum size sheet P2 and is conveyable in the image forming apparatus 100, is conveyed. The second temperature sensor 19B is disposed outboard from the minimum conveyance span W1 and within the maximum conveyance span W2 in the longitudinal direction of the heater 22.

According to the embodiments of the present disclosure, the image forming apparatus 100 employs a center reference conveyance system in which sheets having difference widths, respectively, are centered at a center on the fixing belt 20 in the axial direction thereof while the sheets are conveyed over the fixing belt 20. Accordingly, a center of each of the minimum conveyance span W1 and the maximum conveyance span W2 in the axial direction of the fixing belt 20 (e.g., a center line of each of the minimum size sheet P1 and the maximum size sheet P2 conveyed over the fixing belt 20) is at an identical position, that is, a center Q. The second temperature sensor 19B is disposed opposite the first temperature sensor 19A in the axial direction of the fixing belt 20 with respect to the center Q of each of the minimum conveyance span W1 and the maximum conveyance span W2. For example, the first temperature sensor 19A is disposed opposite the second temperature sensor 19B via the center Q of each of the minimum conveyance span W1 and the maximum conveyance span W2 in the longitudinal direction of the heater 22. The first temperature sensor 19A is asymmetrical to the second temperature sensor 19B with respect to the center Q.

Figure 8:
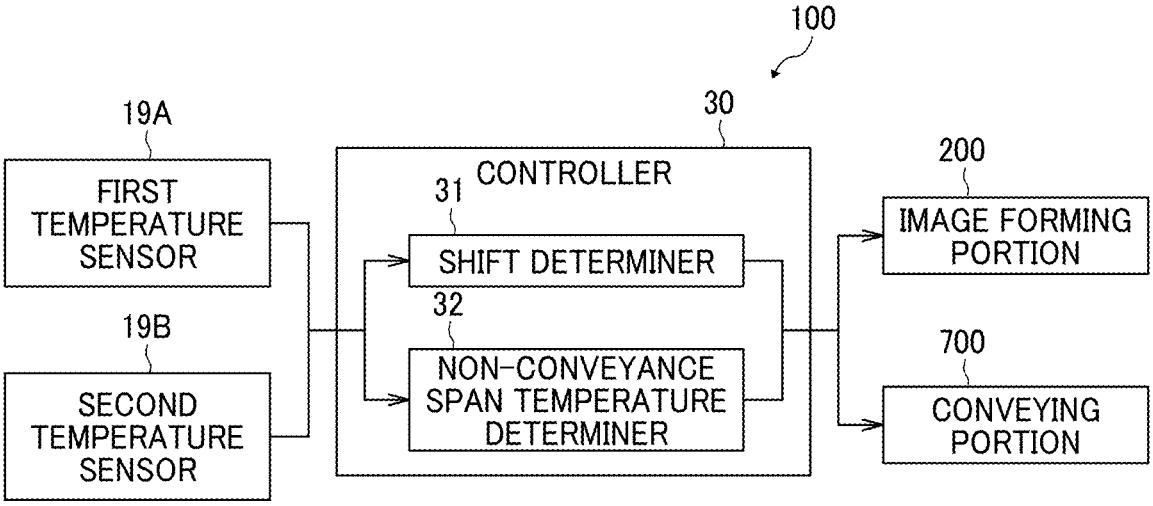
FIG. 8 is a block diagram of the image forming apparatus depicted in FIG. 1, illustrating a controller incorporated therein.

FIG. 8 is a block diagram of the image forming apparatus 100, illustrating the controller 30 according to this embodiment.

As illustrated in FIG. 8, the controller 30 includes a shift determiner 31 and a non-conveyance span temperature determiner 32. For example, the controller 30 is a microcomputer that includes a random access memory (RAM) and a read only memory (ROM). The controller 30 may be located inside the fixing device 9 or the body of the image forming apparatus 100.

The shift determiner 31 determines whether or not the minimum size sheet P1 or the maximum size sheet P2 is shifted based on a temperature of the heater 22, that is detected by at least one of the first temperature sensor 19A and the second temperature sensor 19B. The non-conveyance span temperature determiner 32 determines whether or not overheating occurs in the non-conveyance span NC2 or NC1 based on a temperature of the heater 22, that is detected by at least one of the first temperature sensor 19A and the second temperature sensor 19B.

A description is provided of a shift determination method for determining whether or not a sheet P is shifted with the fixing device 9 according to this embodiment.

Whether or not a sheet P is shifted is determined as below.

Figure 9:
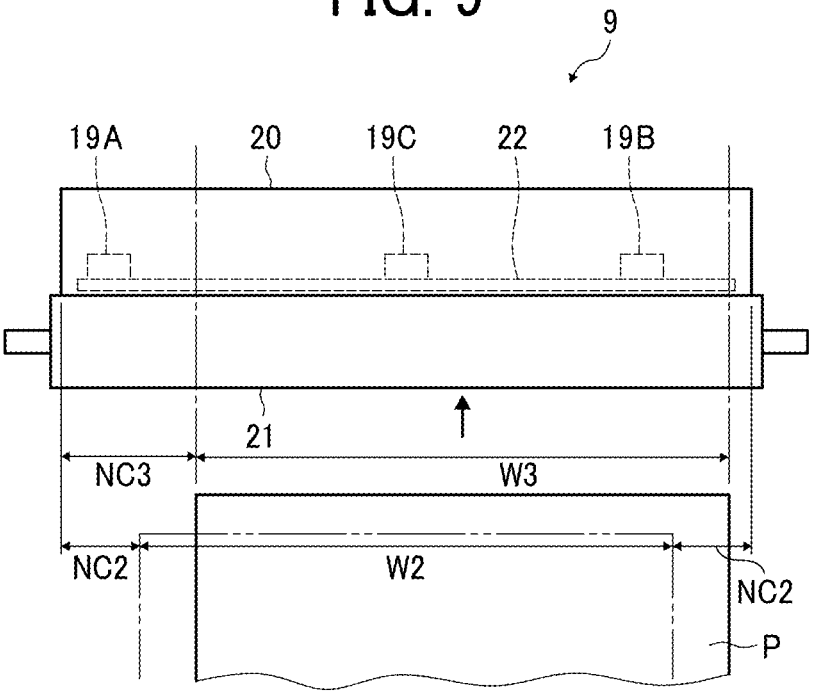
FIG. 9 is a diagram of the fixing device depicted in FIG. 7, for explaining a shift determination method for determining that a sheet is shifted rightward.

For example, as illustrated in FIG. 9, if a sheet P is conveyed in a state in which the sheet P is shifted rightward in FIG. 9 from a proper position indicated with an alternate long and two short dashes line, a non-conveyance span NC3 greater than the non-conveyance span NC2 in the axial direction of the fixing belt 20 is produced on the left of the sheet P in FIG. 9. The non-conveyance span NC3 is disposed outboard from a conveyance span W3 in the longitudinal direction of the heater 22. In this case, the temperature of the heater 22 in the non-conveyance span NC3 where the first temperature sensor 19A is situated tends to increase compared to a normal case in which the sheet P is not shifted. Hence, the first temperature sensor 19A detects an increased temperature of the heater 22. The shift determiner 31 determines whether or not the sheet P is shifted based on the detected temperature of the heater 22. For example, if a temperature of the heater 22, that is detected by the first temperature sensor 19A, is higher than a predetermined temperature, the shift determiner 31 determines that the sheet P is shifted.

Figure 10:
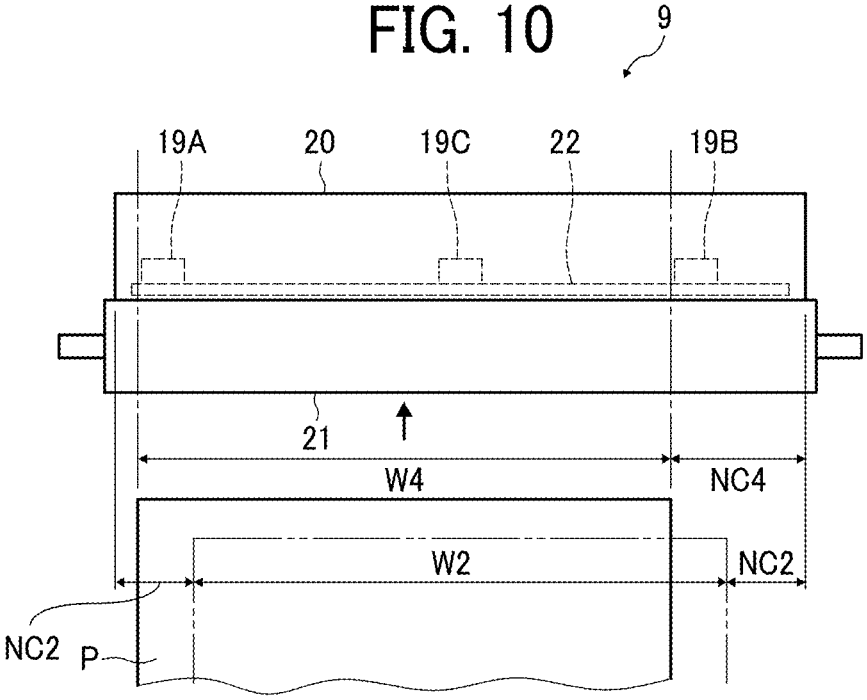
FIG. 10 is a diagram of the fixing device depicted in FIG. 7, for explaining a shift determination method for determining that a sheet is shifted leftward.

As illustrated in FIG. 10, if a sheet P is conveyed in a state in which the sheet P is shifted leftward in FIG. 10 from a proper position indicated with an alternate long and two short dashes line, a non-conveyance span NC4 greater than the non-conveyance span NC2 in the axial direction of the fixing belt 20 is produced on the right of the sheet P in FIG. 10. In this case, a span where the second temperature sensor 19B is situated changes from the maximum conveyance span W2 where the sheet P is conveyed to the non-conveyance span NC4 where the sheet P is not conveyed. Accordingly, the temperature of the heater 22 in the non-conveyance span NC4 where the second temperature sensor 19B is situated increases notably. To address this circumstance, since the second temperature sensor 19B detects a temperature of the heater 22, that is higher than a temperature of the heater 22, that is obtained by a normal temperature increase of the heater 22, the shift determiner 31 determines whether or not the sheet P is shifted based on the higher temperature of the heater 22, that is detected by the second temperature sensor 19B. For example, if the temperature of the heater 22, that is detected by the second temperature sensor 19B, is higher than the predetermined temperature, the shift determiner 31 determines that the sheet P is shifted.

If the sheet P is shifted as illustrated in FIG. 10, the sheet P is shifted leftward in FIG. 10. Hence, a span where the first temperature sensor 19A is situated changes from the non-conveyance span NC2 to a conveyance span W4 where the sheet P is conveyed. In this case, temperature increase of the heater 22 in the conveyance span W4 where the first temperature sensor 19A is situated is suppressed compared to the normal case in which the sheet P is not shifted. Accordingly, if a temperature of the heater 22, that is detected by the first temperature sensor 19A, is lower than the predetermined temperature, the shift determiner 31 may determine that the sheet P is shifted.

Referring to examples illustrated in FIGS. 9 and 10, the above describes the shift determination method with the sheet P having the maximum width as an example. However, the shift determination method is also applicable to conveyance of sheets having other widths. For example, if a sheet P having any width is conveyed, when the sheet P is shifted, the width of each of non-conveyance spans in the axial direction of the fixing belt 20 that are disposed on the left and on the right of the sheet P changes. If at least one of the first temperature sensor 19A and the second temperature sensor 19B detects an abnormal temperature that is different from a normal temperature detected when the sheet P is not shifted, the shift determiner 31 determines that the sheet P is shifted.

A description is provided of an overheating determination method for determining whether or not overheating occurs in the non-conveyance span.

For example, if the maximum size sheet P2 having the maximum width is conveyed in a state in which the maximum size sheet P2 is not shifted, the first temperature sensor 19A disposed outboard from the maximum conveyance span W2 in the longitudinal direction of the heater 22 as illustrated in FIG. 7 detects the temperature of the heater 22 in the non-conveyance span NC2. If the temperature of the heater 22, that is detected by the first temperature sensor 19A, is higher than the predetermined temperature (e.g., an upper limit value), the non-conveyance span temperature determiner 32 determines that overheating occurs in the non-conveyance span NC2. Similarly, also in a case in which a sheet P having a width smaller than the maximum width in the axial direction of the fixing belt 20 is conveyed, the first temperature sensor 19A detects temperature increase in the non-conveyance span NC1. The non-conveyance span temperature determiner 32 determines whether or not temperature increase occurs in the non-conveyance span NC1. If a span where the second temperature sensor 19B is situated changes to the non-conveyance span NC1, the second temperature sensor 19B may detect temperature increase in the non-conveyance span NC1.

Figure 11:
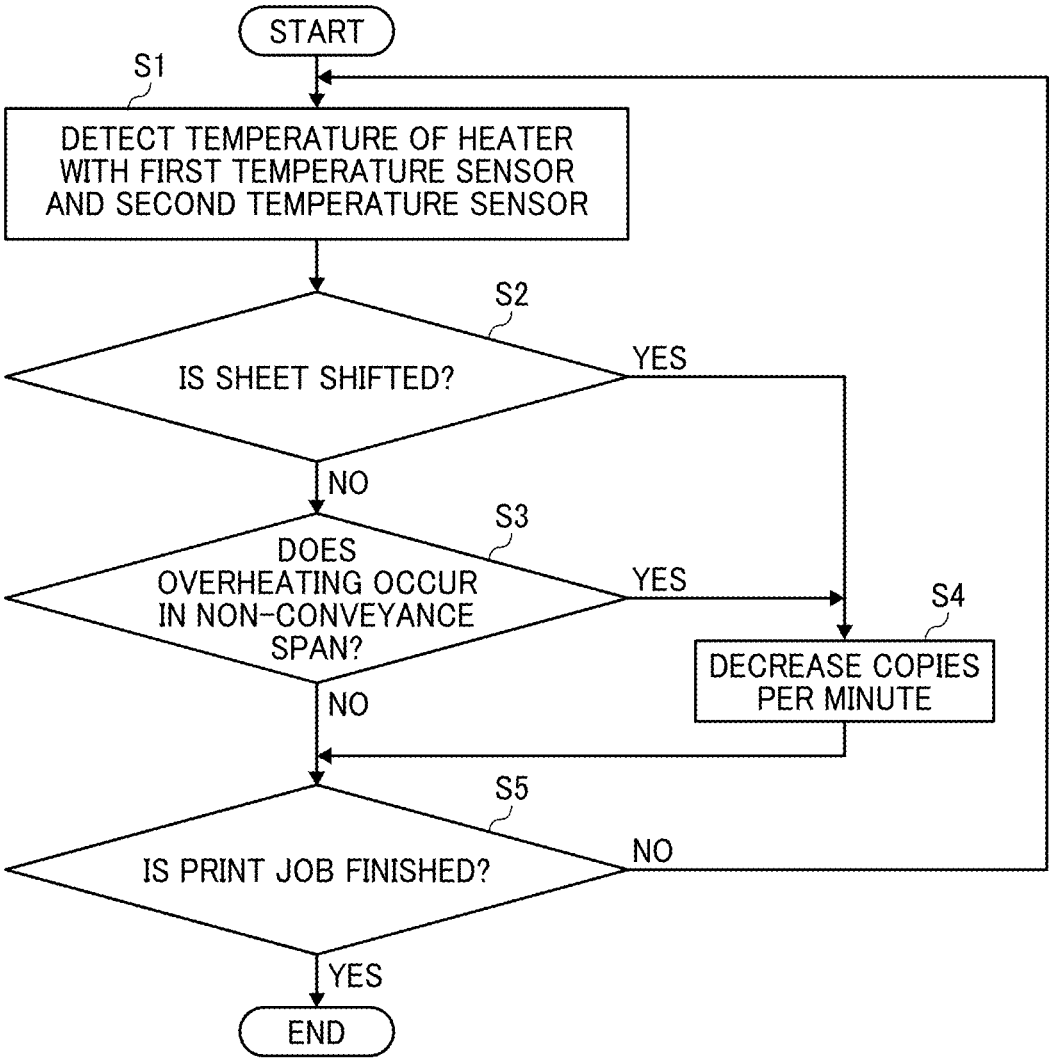
FIG. 11 is a flowchart illustrating a control method employed by the controller depicted in FIG. 8.

FIG. 11 is a flowchart illustrating a control method employed by the controller 30 depicted in FIG. 8 according to this embodiment.

As illustrated in FIG. 11, when the image forming apparatus 100 receives a print job to form an image and conveyance of a sheet P starts, the first temperature sensor 19A and the second temperature sensor 19B detect the temperature of the heater 22 in step S1. In step S2, the shift determiner 31 determines whether or not the sheet P is shifted based on a temperature of the heater 22, that is detected by at least one of the first temperature sensor 19A and the second temperature sensor 19B. In step S3, the non-conveyance span temperature determiner 32 determines whether or not overheating occurs in a non-conveyance span (e.g., the non-conveyance spans NC1, NC2, NC3, and NC4). FIG. 11 illustrates an example in which the non-conveyance span temperature determiner 32 determines whether or not overheating occurs in the non-conveyance span after the shift determiner 31 determines whether or not the sheet P is shifted. Alternatively, an order of determination by the shift determiner 31 and determination by the non-conveyance span temperature determiner 32 is not restricted. Determination of shifting of the sheet P by the shift determiner 31 and determination of overheating by the non-conveyance span temperature determiner 32 may be performed simultaneously.

As a result, if the shift determiner 31 determines that the sheet P is shifted (YES in step S2) or if the non-conveyance span temperature determiner 32 determines that overheating occurs in the non-conveyance span (YES in step S3), the controller 30 performs a control to decrease the number of prints per minute, that is, copies per minute (CPM), in step S4. For example, based on a determination result sent from the shift determiner 31 or the non-conveyance span temperature determiner 32, the controller 30 depicted in FIG. 8 controls the image forming portion 200 and the conveying portion 700 to increase an interval between conveyance of a preceding sheet P and conveyance of a subsequent sheet P or decrease the conveying speed at which the sheet P is conveyed, thus decreasing the number of prints per minute. Accordingly, the heat generation amount of the heater 22 decreases. Hence, even if temperature increase caused by shifting of the sheet P occurs or even if temperature increase occurs in the non-conveyance span, the fixing device 9 suppresses temperature increase in the non-conveyance span.

If the shift determiner 31 determines that the sheet P is shifted, the controller 30 may perform a control to interrupt the print job instead of the control to decrease the CPM. In this case, the controller 30 may notify shifting of the sheet P to a user.

Thereafter, a process of detecting the temperature of the heater 22 by the first temperature sensor 19A and the second temperature sensor 19B in step S1, a process of determining shifting of the sheet P by the shift determiner 31 in step S2, a process of determining overheating in the non-conveyance span by the non-conveyance span temperature determiner 32 in step S3, and a process of controlling the CPM in step S4 are repeated until the print job is finished. In step S5, the controller 30 determines whether or not the print job is finished. If the controller 30 determines that the print job is finished (YES in step S5), the control method described above with reference to FIG. 11 finishes.

As described above, the fixing device 9 according to the first embodiment detects both temperature increase in the non-conveyance span on the fixing belt 20 and shifting of the sheet P by using the first temperature sensor 19A and the second temperature sensor 19B. Thus, the fixing device 9 according to the first embodiment detects both temperature increase in the non-conveyance span on the fixing belt 20 and shifting of the sheet P by using a decreased number of temperature sensors, that is, two temperature sensors (e.g., the first temperature sensor 19A and the second temperature sensor 19B), thus reducing manufacturing costs of the fixing device 9 and downsizing the fixing device 9.

According to this embodiment, the first temperature sensor 19A contacts the heater 22 as illustrated in FIG. 2. Hence, the first temperature sensor 19A detects the temperature of a portion that is heated most in the fixing device 9 (e.g., the heater 22) in the non-conveyance span. Accordingly, the first temperature sensor 19A detects influence of heat inflicted on the heater 22 and peripheral elements surrounding the heater 22 (e.g., the heater holder 23, the fixing belt 20, and the like) precisely, thus preventing the heater 22 and the peripheral elements from being damaged by heat. For example, if the heater holder 23 is made of resin and the temperature of the heater holder 23 exceeds a heat-resistant temperature due to temperature increase of the heater 22 in the non-conveyance span, the configuration of the fixing device 9 according to this embodiment is preferably employed. In this case, if the first temperature sensor 19A also serves as a safety device that detects overheating of the heater 22 and interrupts power supply to the heater 22, another safety device is not provided separately from the first temperature sensor 19A, reducing manufacturing costs.

Figure 12:
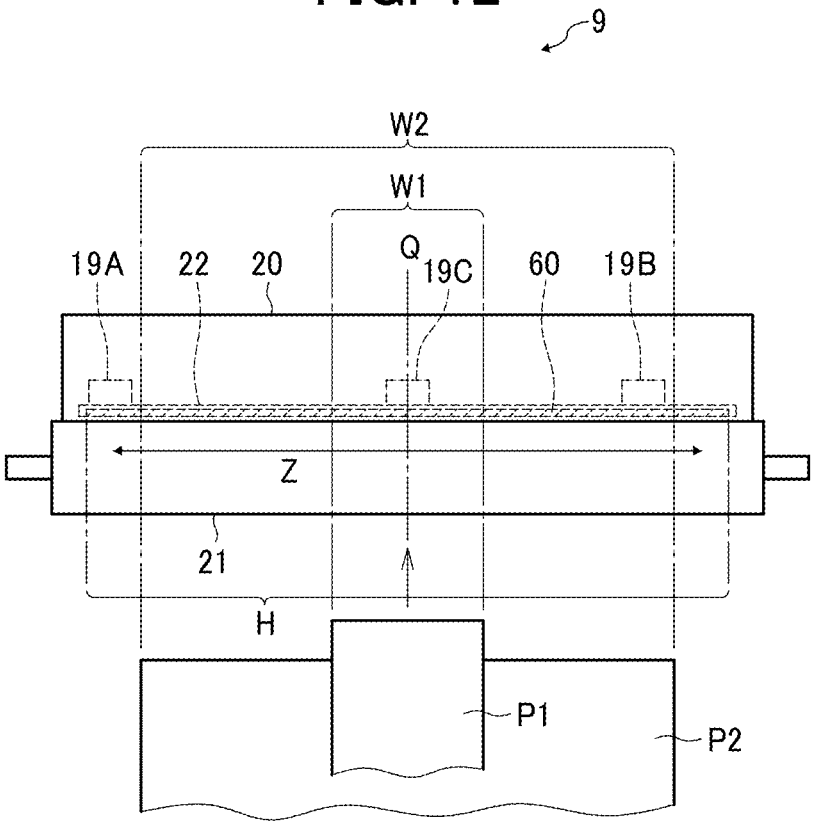
FIG. 12 is a diagram of the fixing device depicted in FIG. 7, illustrating a desired arrangement of a first temperature sensor and a second temperature sensor incorporated in the fixing device.
Figure 13:
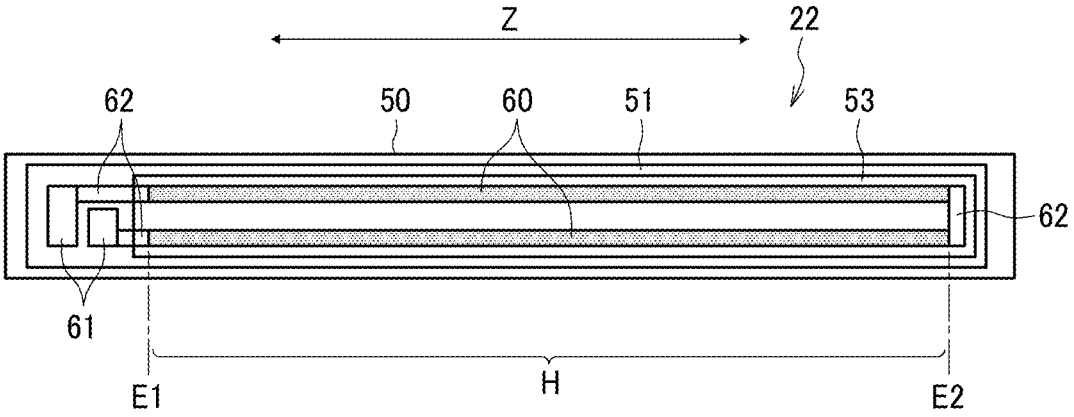
FIG. 13 is a diagram of the heater depicted in FIG. 3, illustrating a heat generation span of resistive heat generators that are incorporated in the heater and extended continuously in a width direction of a sheet.
Figure 14:
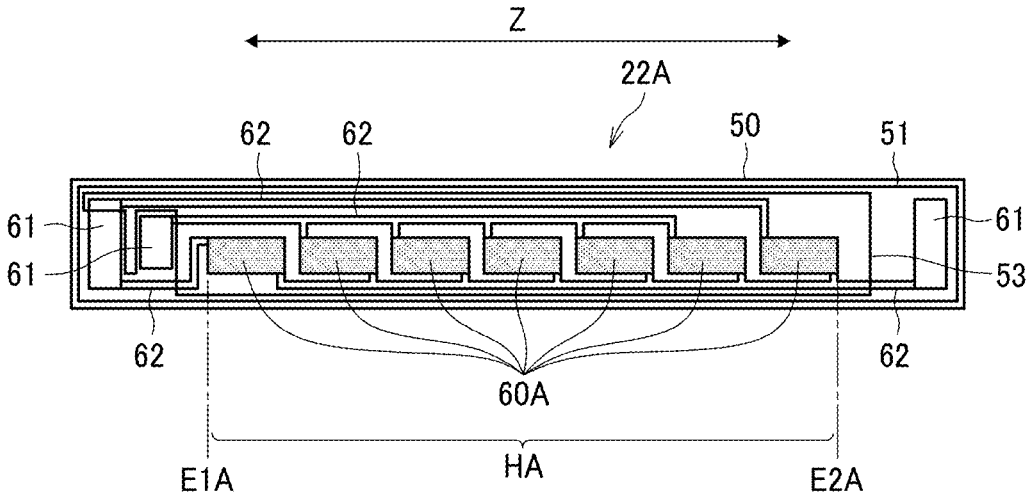
FIG. 14 is a diagram of a heater installable in the fixing device depicted in FIG. 2, illustrating a heat generation span of resistive heat generators that are incorporated in the heater and extended discontinuously in the width direction of the sheet.

As illustrated in FIG. 12, the first temperature sensor 19A and the second temperature sensor 19B are preferably disposed opposite the heater 22 in a heat generation span H in the longitudinal direction Z, that is, the width direction of the minimum size sheet P1 and the maximum size sheet P2, where the heater 22 generates heat. For example, as illustrated in FIG. 13, the heater 22 includes the resistive heat generators 60 each of which extends continuously in the longitudinal direction Z, that is, the width direction of the sheet P. A heat generation span of the heater 22 defines the heat generation span H from one lateral end E1 to another lateral end E2 of each of the resistive heat generators 60 in the width direction of the sheet P. As illustrated in FIG. 14, a heater 22A includes a plurality of resistive heat generators 60A arranged discontinuously in the longitudinal direction Z, that is, the width direction of the sheet P. A heat generation span of the heater 22A defines a heat generation span HA from one lateral end E1A of the leftmost resistive heat generator 60A in FIG. 14 to another lateral end E2A of the rightmost resistive heat generator 60A in FIG. 14 in the width direction of the sheet P. The heat generation span HA of the heater 22A is particularly subject to a high temperature. To address this circumstance, the first temperature sensor 19A and the second temperature sensor 19B are disposed opposite the heater 22A in the heat generation span HA, thus improving accuracy in detecting temperature increase in the non-conveyance span and shifting of the sheet P.

A temperature detection target of which temperature is detected by the first temperature sensor 19A and the second temperature sensor 19B is not limited to the heater 22. The first temperature sensor 19A and the second temperature sensor 19B may detect the temperature of the fixing belt 20 or the pressure roller 21 other than the heater 22. For example, if the first temperature sensor 19A and the second temperature sensor 19B are disposed opposite the heater 22 as described above with respect to the minimum conveyance span W1 and the maximum conveyance span W2, even if the temperature detection target is the fixing belt 20 or the pressure roller 21, the first temperature sensor 19A and the second temperature sensor 19B detect both temperature increase in the non-conveyance span and shifting of the sheet P by a method similar to the method described above. The first temperature sensor 19A may not be entirely disposed outboard from the maximum conveyance span W2 in the longitudinal direction of the heater 22. For example, at least a part of a temperature detecting portion of the first temperature sensor 19A may be disposed outboard from the maximum conveyance span W2 in the longitudinal direction of the heater 22.

A description is provided of embodiments of the present disclosure, that are different from the first embodiment described above.

Hereinafter, the embodiments are described mainly of configurations that are different from those of the first embodiment described above. A description of other configurations that are basically common to the first embodiment described above is omitted properly.

Figure 15:
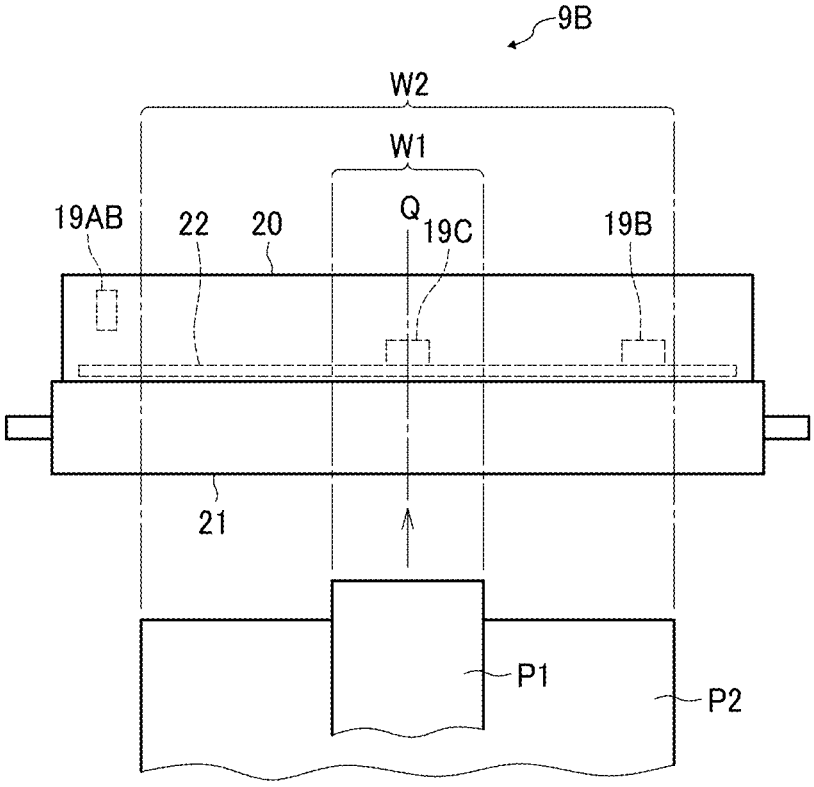
FIG. 15 is a schematic diagram of a fixing device according to a second embodiment of the present disclosure, that is installable in the image forming apparatus depicted in FIG. 1.

FIG. 15 is a schematic diagram of a fixing device 9B according to a second embodiment of the present disclosure.

As illustrated in FIG. 15, the fixing device 9B according to the second embodiment includes a first temperature sensor 19AB that is disposed opposite the fixing belt 20 and detects the temperature of the fixing belt 20 instead of the heater 22. For example, the first temperature sensor 19AB is disposed opposite the inner circumferential surface of the fixing belt 20 with or without contacting the inner circumferential surface of the fixing belt 20.

Since the heater 22 heats the fixing belt 20 according to this embodiment directly, the fixing belt 20 is a part that is susceptible to heat from the heater 22 among parts that construct the fixing device 9B. To address this circumstance, according to this embodiment, the first temperature sensor 19AB is disposed opposite the fixing belt 20 and detects the temperature of the fixing belt 20 heated by the heater 22 directly. Accordingly, the first temperature sensor 19AB detects the temperature of the fixing belt 20 precisely, preventing the fixing belt 20 from being damaged by heat more precisely. According to this embodiment, the first temperature sensor 19AB is disposed within the loop formed by the fixing belt 20. Accordingly, the first temperature sensor 19AB downsizes the fixing device 9B compared to a configuration in which the first temperature sensor 19AB is disposed outside the loop formed by the fixing belt 20.

Figure 16:
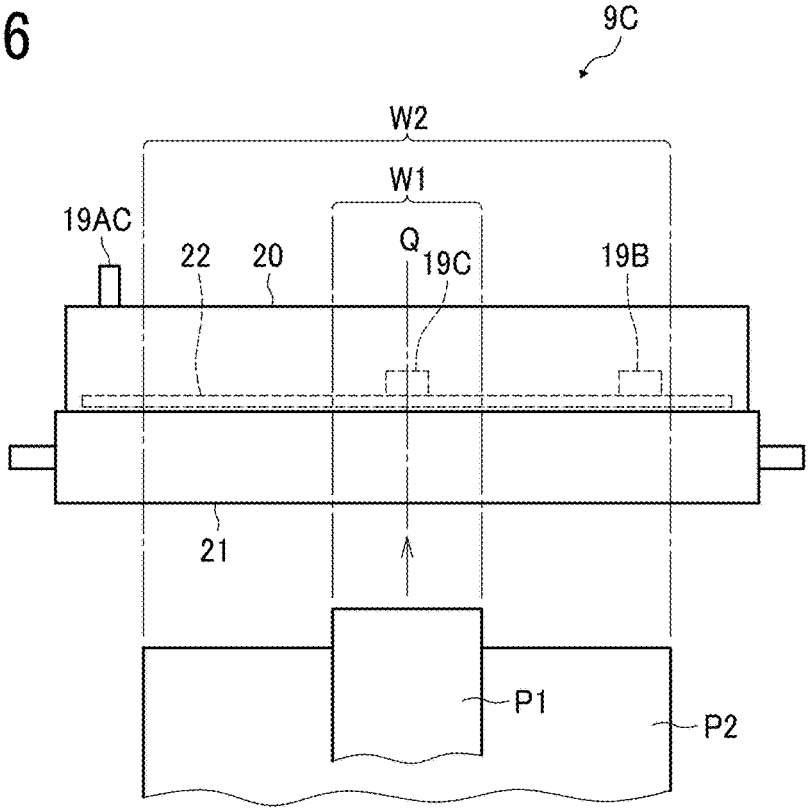
FIG. 16 is a schematic diagram of a fixing device according to a third embodiment of the present disclosure, that is installable in the image forming apparatus depicted in FIG. 1.

FIG. 16 is a schematic diagram of a fixing device 9C according to a third embodiment of the present disclosure.

As illustrated in FIG. 16, the fixing device 9C according to the third embodiment includes a first temperature sensor 19AC that contacts the outer circumferential surface of the fixing belt 20. In the fixing device 9C according to the third embodiment also, like in the fixing device 9B according to the second embodiment described above, the first temperature sensor 19AC detects the temperature of the fixing belt 20 precisely, preventing the fixing belt 20 from being damaged by heat more precisely.

According to this embodiment, the first temperature sensor 19AC is disposed outside the loop formed by the fixing belt 20. Hence, the first temperature sensor 19AC may be a temperature sensor having a decreased heat resistance. If the first temperature sensor 19AC is disposed within the loop formed by the fixing belt 20, the first temperature sensor 19AC is susceptible to heat from the heater 22. Particularly, the first temperature sensor 19AC disposed in the non-conveyance span is subject to a high temperature. Conversely, the first temperature sensor 19AC disposed outside the loop formed by the fixing belt 20 is less susceptible to heat compared to a configuration in which the first temperature sensor 19AC is disposed within the loop formed by the fixing belt 20. Thus, temperature increase of the first temperature sensor 19AC is suppressed. As the first temperature sensor 19AC is disposed outside the loop formed by the fixing belt 20, the first temperature sensor 19AC does not suffer from temperature increase easily. Hence, a temperature sensor having a decreased heat resistance is employed as the first temperature sensor 19AC, reducing manufacturing costs. The first temperature sensor 19AC may not contact the outer circumferential surface of the fixing belt 20. For example, the first temperature sensor 19AC may be disposed opposite the outer circumferential surface of the fixing belt 20 without contacting the outer circumferential surface of the fixing belt 20.

Figure 17:
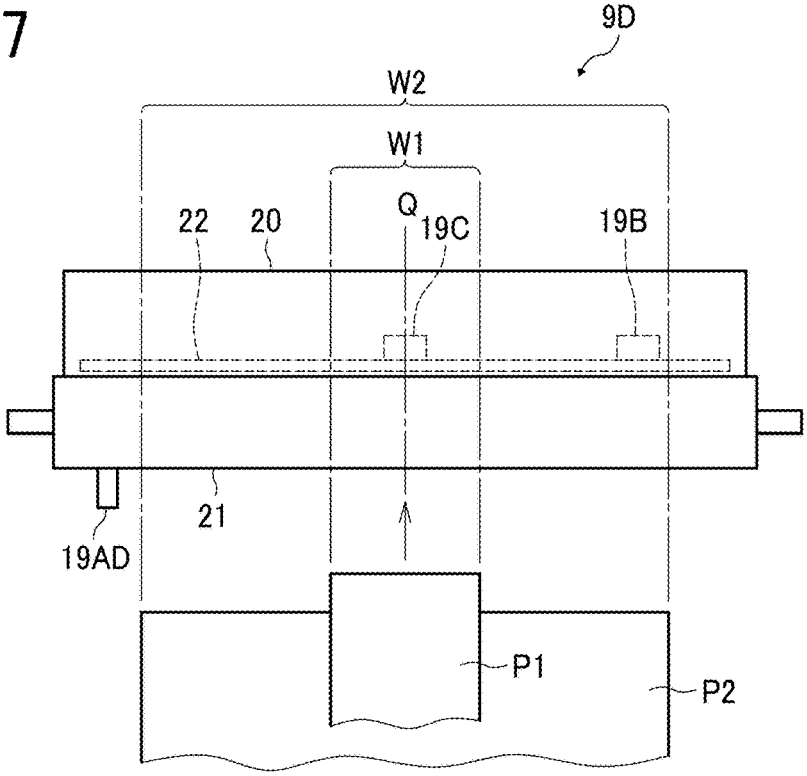
FIG. 17 is a schematic diagram of a fixing device according to a fourth embodiment of the present disclosure, that is installable in the image forming apparatus depicted in FIG. 1.

FIG. 17 is a schematic diagram of a fixing device 9D according to a fourth embodiment of the present disclosure.

As illustrated in FIG. 17, the fixing device 9D according to the fourth embodiment includes a first temperature sensor 19AD that is disposed opposite an outer circumferential surface of the pressure roller 21. The first temperature sensor 19AD detects the temperature of the pressure roller 21. Since the heater 22 does not heat the pressure roller 21 directly, the first temperature sensor 19AD disposed outside the pressure roller 21 is less susceptible to heat from the heater 22. As the first temperature sensor 19AD is disposed outside the pressure roller 21, a temperature sensor having a decreased heat resistance is employed as the first temperature sensor 19AD, reducing manufacturing costs. The first temperature sensor 19AD may contact the outer circumferential surface of the pressure roller 21 or may be disposed opposite the outer circumferential surface of the pressure roller 21 without contacting the outer circumferential surface of the pressure roller 21.

Figure 18:
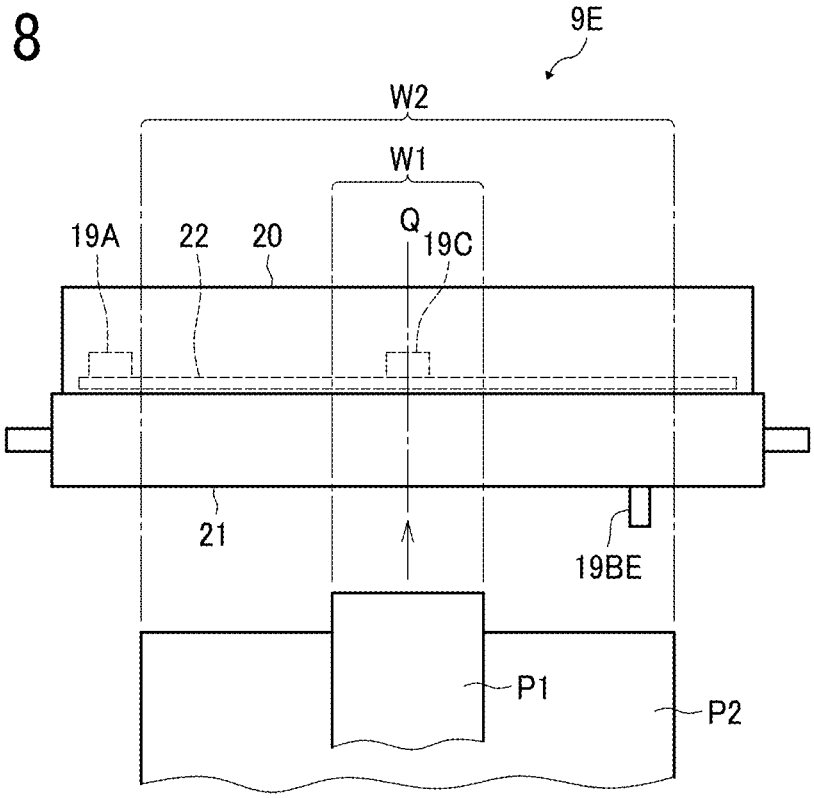
FIG. 18 is a schematic diagram of a fixing device according to a fifth embodiment of the present disclosure, that is installable in the image forming apparatus depicted in FIG. 1.

FIG. 18 is a schematic diagram of a fixing device 9E according to a fifth embodiment of the present disclosure.

As illustrated in FIG. 18, the fixing device 9E according to the fifth embodiment includes a second temperature sensor 19BE that is disposed opposite the outer circumferential surface of the pressure roller 21. The second temperature sensor 19BE detects the temperature of the pressure roller 21. If the second temperature sensor 19BE is within a conveyance span of a sheet that is conveyed, for example, if the conveyed sheet is the maximum size sheet P2 that is conveyed in the maximum conveyance span W2 where the second temperature sensor 19BE is situated, the controller 30 controls the temperature of the heater 22 based on a temperature of the pressure roller 21, that is detected by the second temperature sensor 19BE. The second temperature sensor 19BE may contact the outer circumferential surface of the pressure roller 21 or may be disposed opposite the outer circumferential surface of the pressure roller 21 without contacting the outer circumferential surface of the pressure roller 21.

Figure 19:
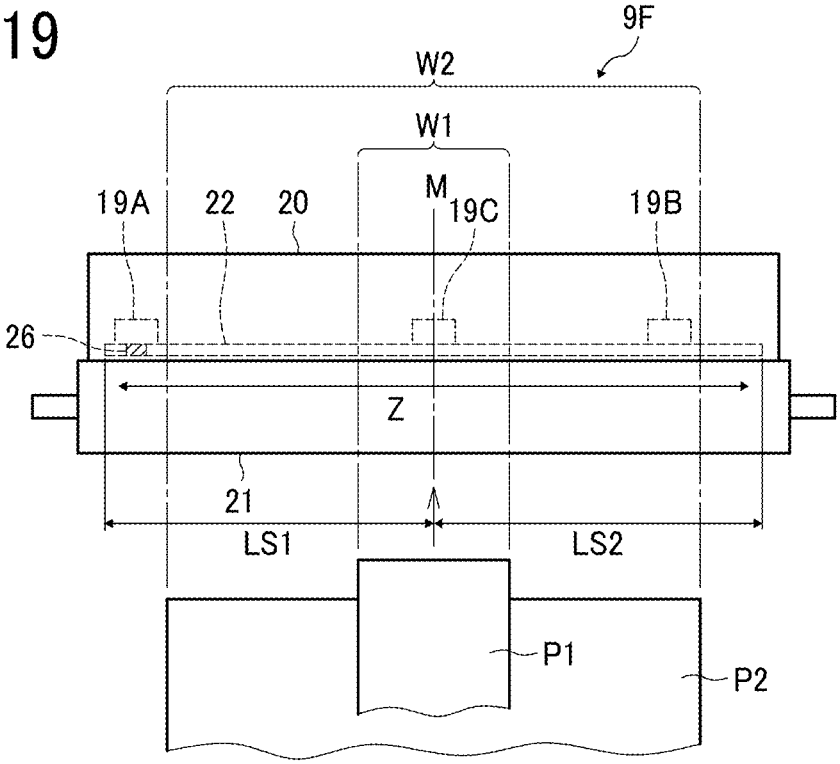
FIG. 19 is a schematic diagram of a fixing device according to a sixth embodiment of the present disclosure, that is installable in the image forming apparatus depicted in FIG. 1.

FIG. 19 is a schematic diagram of a fixing device 9F according to a sixth embodiment of the present disclosure.

As illustrated in FIG. 19, the fixing device 9F according to the sixth embodiment includes a positioner 26 mounted on the heater 22 in one lateral end span LS1 disposed outboard from a center M of the heater 22 in the longitudinal direction thereof, that is, the longitudinal direction Z. For example, the positioner 26 is mounted on one lateral end of the heater 22 in the longitudinal direction thereof. The positioner 26 engages the heater holder 23 depicted in FIG. 2, for example. The positioner 26 serves as an engagement (e.g., a projection or a recess) that holds the heater 22 and prevents the heater 22 from shifting in the longitudinal direction thereof.

The positioner 26 mounted on the heater 22 positions the heater 22 precisely in the longitudinal direction thereof in one lateral end span LS1 of the heater 22, where the positioner 26 is disposed. Conversely, in another lateral end span LS2 of the heater 22, where the positioner 26 is not disposed, as the temperature of the heater 22 increases, the heater 22 expands thermally and shifts in the longitudinal direction thereof. Accordingly, if a temperature sensor is disposed in another lateral end span LS2 of the heater 22, where the heater 22 may shift easily, when the heater 22 expands thermally, the heater 22 may shift relative to the temperature sensor, causing variation in the temperature detected by the temperature sensor. The heat generation amount of the heater 22 is subject to rapid decrease particularly at each lateral end of the heater 22 in the longitudinal direction thereof. Hence, if the heater 22 shifts relative to the temperature sensor, variation in the temperature detected by the temperature sensor disposed particularly at each lateral end of the heater 22 in the longitudinal direction thereof increases. To address this circumstance, the temperature sensor is preferably disposed in one lateral end span LS1 of the heater 22, where the positioner 26 is disposed.

In view of the above, in the fixing device 9F according to the sixth embodiment, the first temperature sensor 19A is disposed in one lateral end span LS1 of the heater 22, that is placed with the positioner 26 and is defined by the center M of the heater 22 in the longitudinal direction thereof. Accordingly, even if the heater 22 expands thermally, the first temperature sensor 19A is barely susceptible to shifting relative to the heater 22 due to thermal expansion of the heater 22, improving accuracy in temperature detection.

Figure 20:
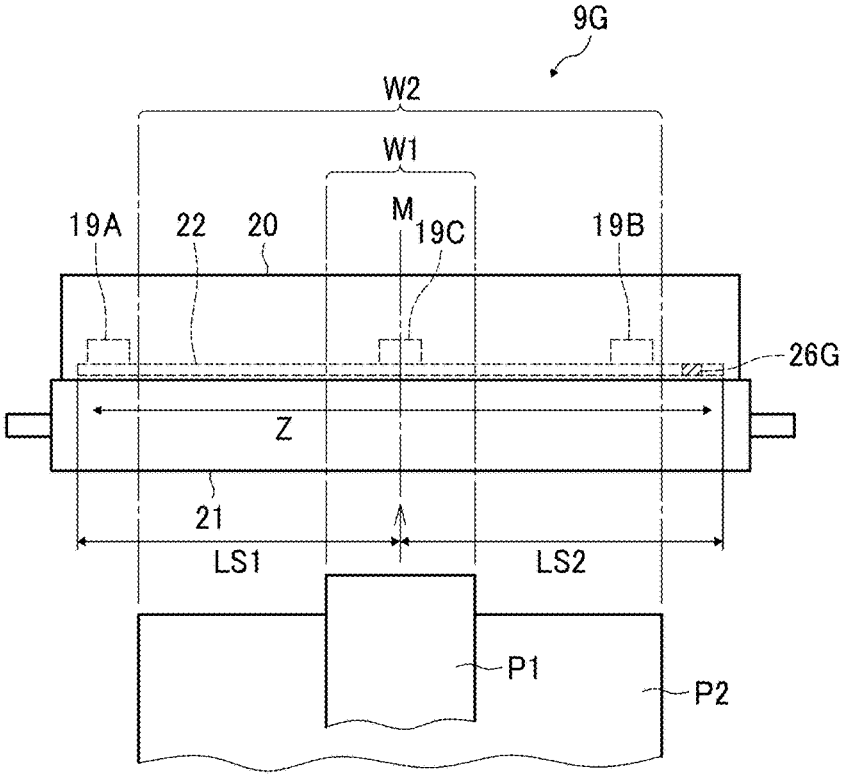
FIG. 20 is a schematic diagram of a fixing device according to a seventh embodiment of the present disclosure, that is installable in the image forming apparatus depicted in FIG. 1.

FIG. 20 is a schematic diagram of a fixing device 9G according to a seventh embodiment of the present disclosure.

As illustrated in FIG. 20, the fixing device 9G according to the seventh embodiment, like the fixing device 9F according to the sixth embodiment, includes a positioner 26G that prevents the heater 22 from being shifted in the longitudinal direction thereof. However, in the fixing device 9G according to the seventh embodiment depicted in FIG. 20, unlike in the fixing device 9F according to the sixth embodiment depicted in FIG. 19, the second temperature sensor 19B, not the first temperature sensor 19A, is disposed in another lateral end span LS2 of the heater 22, that is placed with the positioner 26G and is defined by the center M of the heater 22 in the longitudinal direction thereof. For example, the positioner 26G is mounted on another lateral end of the heater 22 in the longitudinal direction thereof. Accordingly, in the fixing device 9G, the second temperature sensor 19B is barely susceptible to shifting relative to the heater 22 due to thermal expansion of the heater 22, improving accuracy in temperature detection of the second temperature sensor 19B.

The above-described embodiments are applied to the image forming apparatus 100 that employs the center reference conveyance system. Alternatively, instead of the image forming apparatus 100 employing the center reference conveyance system, the embodiments of the present disclosure may be applied to an image forming apparatus that employs a lateral end reference conveyance system in which sheets having difference widths, respectively, are aligned at one lateral end of each of the sheets in a width direction thereof while the sheets are conveyed over the fixing belt 20, as illustrated in FIG. 21.

Figure 21:
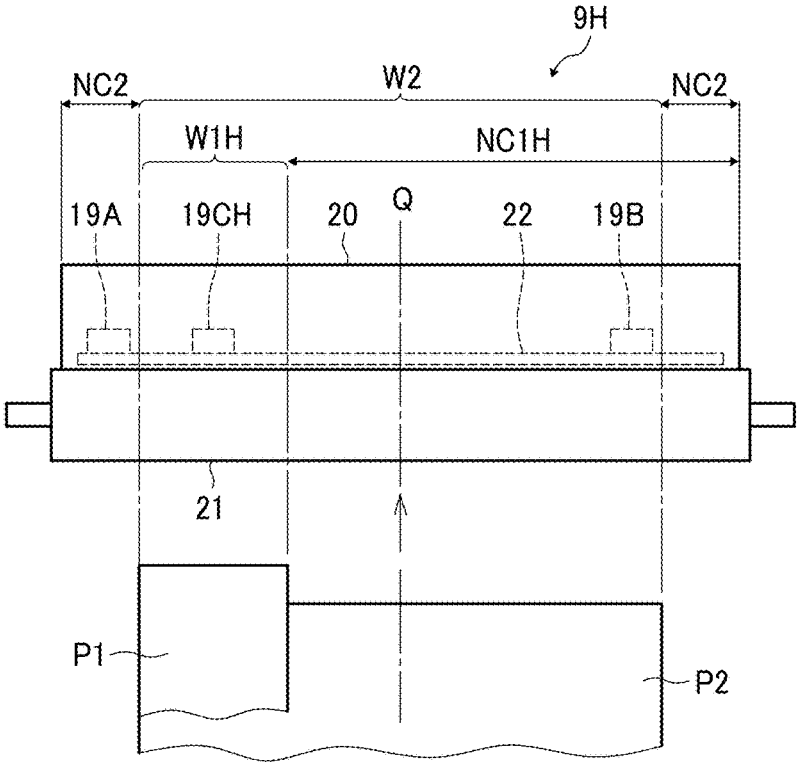
FIG. 21 is a schematic diagram of a fixing device installed in an image forming apparatus employing a lateral end reference conveyance system as a first variation of the fixing device depicted in FIG. 7.

For example, as illustrated in FIG. 21, also in a fixing device 9H employing the lateral end reference conveyance system, like in the embodiments described above, the first temperature sensor 19A is disposed outboard from the maximum conveyance span W2 in the longitudinal direction of the heater 22. The second temperature sensor 19B is disposed outboard from a minimum conveyance span W1H and within the maximum conveyance span W2 in the longitudinal direction of the heater 22. The second temperature sensor 19B is disposed opposite the first temperature sensor 19A in the longitudinal direction of the heater 22 via the center Q of the maximum conveyance span W2. The fixing device 9H includes a third temperature sensor 19CH disposed within the minimum conveyance span W1H of which one lateral edge in the axial direction of the fixing belt 20 overlaps one lateral edge of the maximum conveyance span W2 in the axial direction of the fixing belt 20. Accordingly, based on the embodiments described above, even if the fixing device 9H does not incorporate an increased number of temperature sensors, the fixing device 9H allows the first temperature sensor 19A and the second temperature sensor 19B to detect both temperature increase in the non-conveyance span NC2 disposed outboard from the maximum conveyance span W2 and a non-conveyance span NC1H disposed outboard from the minimum conveyance span W1H in the axial direction of the fixing belt 20 and shifting of the minimum size sheet P1 and the maximum size sheet P2.

The embodiments of the present disclosure may be applied to fixing devices other than the fixing devices 9, 9A, 9B, 9C, 9D, 9E, 9F, 9G, and 9H. For example, the embodiments of the present disclosure are also applicable to fixing devices 9I and 9J illustrated in FIGS. 22 and 23, respectively.

Figure 22:
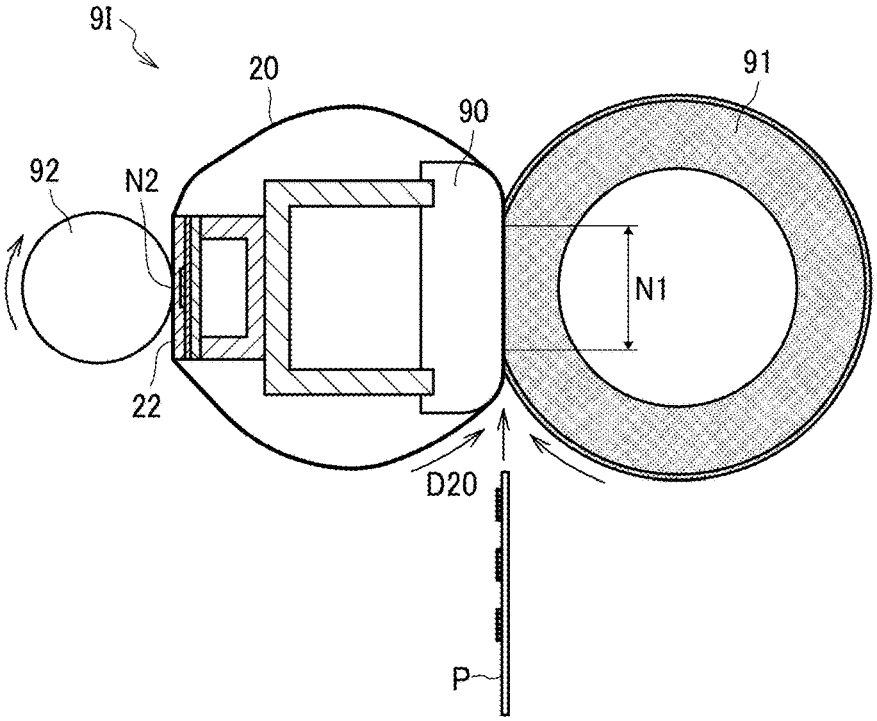
FIG. 22 is a schematic cross-sectional view of a fixing device as a second variation of the fixing device depicted in FIG. 2.

The fixing device 9I illustrated in FIG. 22, unlike the fixing device 9 depicted in FIG. 2, has a fixing nip N1 and a heating nip N2 disposed separately from the fixing nip N1. A sheet P is conveyed through the fixing nip N1. The heater 22 heats the fixing belt 20 at the heating nip N2 so that the fixing belt 20 fixes a toner image on the sheet P at the fixing nip N1. For example, the heater 22 is disposed 180 degrees opposite a nip formation pad 90 in the rotation direction D20 of the fixing belt 20. Separate, pressure rollers 91 and 92 serving as rotators are pressed against the nip formation pad 90 and the heater 22 via the fixing belt 20, forming the fixing nip N1 and the heating nip N2, respectively.

Figure 23:
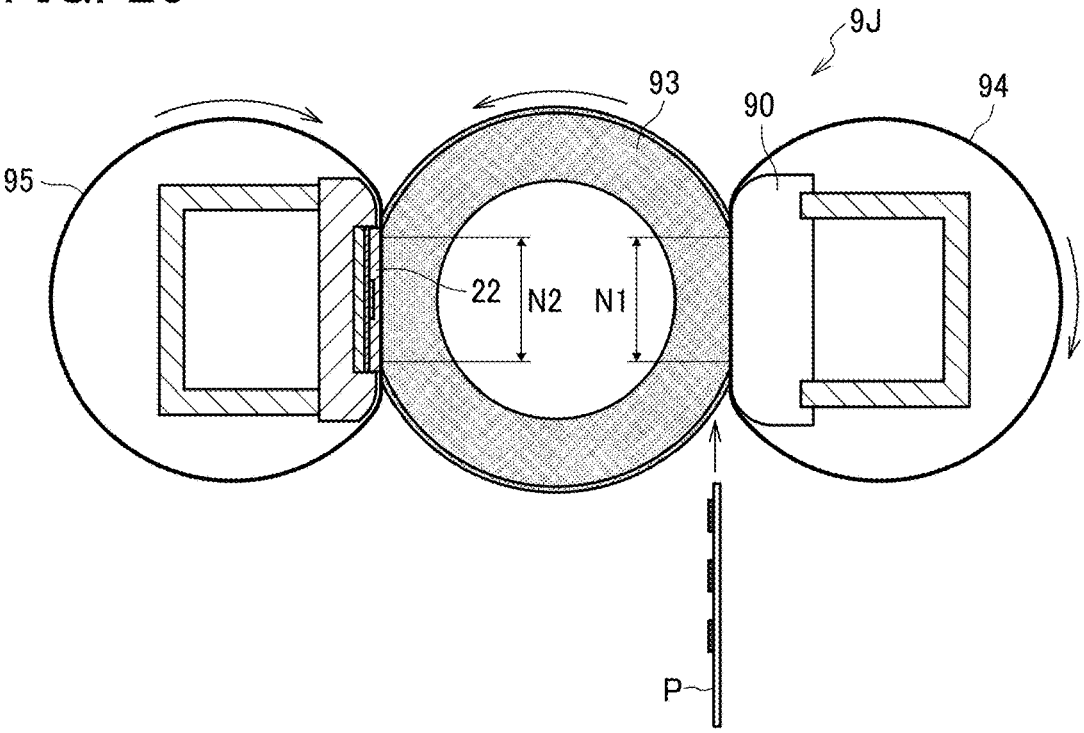
FIG. 23 is a schematic cross-sectional view of a fixing device as a third variation of the fixing device depicted in FIG. 2.

As illustrated in FIG. 23, the fixing device 9J includes a roller 93 sandwiched between belts 94 and 95. Like the fixing device 9I depicted in FIG. 22, the fixing device 9J has the fixing nip N1 and the heating nip N2 disposed separately from the fixing nip N1. For example, the nip formation pad 90 presses the belt 94, that is, one of the belts, that is disposed on the right of the roller 93 in FIG. 23, against the roller 93 disposed at a center interposed between the belts 94 and 95. The heater 22 presses the belt 95, that is, another one of the belts, that is disposed on the left of the roller 93 in FIG. 23, against the roller 93 disposed at the center interposed between the belts 94 and 95. Thus, the fixing nip N1 and the heating nip N2 are formed.

Each of the fixing device 9I depicted in FIG. 22 and the fixing device 9J depicted in FIG. 23 also includes the first temperature sensor 19A and the second temperature sensor 19B that are disposed at positions described above in the embodiments. Even if each of the fixing devices 9I and 9J does not incorporate an increased number of temperature sensors, each of the fixing devices 9I and 9J allows the first temperature sensor 19A and the second temperature sensor 19B to detect both temperature increase in the non-conveyance span and shifting of the sheet P. The temperature detection target of which temperature is detected by the first temperature sensor 19A and the second temperature sensor 19B is not limited to the heater 22. For example, the temperature detection target may be one of three rotators (e.g., the pressure rollers 91 and 92 and the fixing belt 20 depicted in FIG. 22 or the roller 93 and the belts 94 and 95 depicted in FIG. 23) that are pressed against each other to form the fixing nip N1 and the heating nip N2.

Application of the embodiments of the present disclosure is not limited to a fixing device (e.g., the fixing devices 9, 9A, 9B, 9C, 9D, 9E, 9F, 9G, 9H, 9I, and 9J) as one example of a heating device incorporated in an image forming apparatus (e.g., the image forming apparatus 100). For example, the embodiments of the present disclosure are also applicable to a heating device such as a dryer installed in an image forming apparatus employing an inkjet method. The dryer heats a sheet bearing ink or liquid and dries the ink or the liquid on the sheet.

A description is provided of advantages of a heating device (e.g., the fixing devices 9, 9A, 9B, 9C, 9D, 9E, 9F, 9G, 9H, 9I, and 9J).

As illustrated in FIGS. 2, 4, and 7, the heating device includes a plurality of rotators (e.g., the fixing belt 20 and the pressure roller 21), a heater (e.g., the heater 22), and a plurality of temperature sensors (e.g., the first temperature sensor 19A and the second temperature sensor 19B).

The plurality of rotators, serving as a first rotator and a second rotator, contacts each other to form a nip (e.g., the fixing nip N) therebetween. The heater includes a resistive heat generator (e.g., the resistive heat generators 60) that generates heat by energization and a base layer (e.g., the base layer 50) that mounts the resistive heat generator. The heater heats at least one of the plurality of rotators. The plurality of temperature sensors detects a temperature of at least one of the plurality of rotators and the heater. One of the plurality of temperature sensors is a first temperature sensor (e.g., the first temperature sensor 19A) that is disposed outboard from an increased conveyance span (e.g., the maximum conveyance span W2) in a longitudinal direction of the heater. An increased size sheet (e.g., the maximum size sheet P2), having an increased width (e.g., a maximum width) in the longitudinal direction of the heater, is conveyed through the nip in the increased conveyance span. The maximum width is within a width of the first rotator in an axial direction thereof. Another one of the plurality of temperature sensors is a second temperature sensor (e.g., the second temperature sensor 19B) that is disposed outboard from a decreased conveyance span (e.g., the minimum conveyance span W1) in the longitudinal direction of the heater. A decreased size sheet (e.g., the minimum size sheet P1), having a decreased width (e.g., a minimum width) in the longitudinal direction of the heater, is conveyed through the nip in the decreased conveyance span. The minimum width is within the width of the first rotator in the axial direction of the first rotator. The second temperature sensor is disposed within the increased conveyance span in the longitudinal direction of the heater. The second temperature sensor is disposed opposite the first temperature sensor via a center (e.g., the center Q) of the increased conveyance span in the longitudinal direction of the heater.

Accordingly, the heating device incorporates a decreased number of temperature sensors that detect both shifting of the increased size sheet and the decreased size sheet and temperature increase in a non-conveyance span (e.g., the non-conveyance spans NC1, NC2, NC3, and NC4) where the increased size sheet and the decreased size sheet are not conveyed. Thus, the heating device achieves reduction of manufacturing costs and downsizing.

According to the embodiments described above, the fixing belt 20 serves as a fixing rotator. Alternatively, a fixing roller, a fixing film, a fixing sleeve, or the like may be used as a fixing rotator. Further, the pressure roller 21 serves as an opposed rotator. Alternatively, a pressure belt or the like may be used as an opposed rotator.

According to the embodiments described above, the image forming apparatus 100 is a printer. Alternatively, the image forming apparatus 100 may be a copier, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A heating device, comprising:

a belt;

a roller configured to contact the belt to form a nip between the belt and the roller;

a heater configured to generate heat to heat at least one of the belt and the roller;

a first temperature sensor disposed in contact with an outer circumferential surface of the belt and opposite the heater with a gap therebetween, the first temperature sensor configured to detect a temperature of the belt; and a second temperature sensor disposed in contact with the heater or opposite the heater with a gap therebetween, the second temperature sensor configured to detect the temperature of the heater, wherein the first temperature sensor is disposed outside of a first conveyance span in a longitudinal direction of the heater, the first conveyance span being where a first sheet having a first width in the longitudinal direction of the heater is conveyed through the nip, the second temperature sensor is disposed outside of a second conveyance span in the longitudinal direction of the heater, the second conveyance span being where a second sheet having a second width in the longitudinal direction of the heater is conveyed through the nip, the second conveyance span is smaller than and within the first conveyance span, the second width is smaller than the first width, and the second temperature sensor is disposed within the first conveyance span on one side of a center of the first conveyance span and the first temperature sensor is disposed on another side of the center of the first conveyance span.

2. The heating device according to claim 1, wherein the heater includes:

a resistive heat generator configured to generate the heat by energization; and a base layer configured to mount the resistive heat generator.

3. The heating device according to claim 1, wherein the first conveyance span includes a maximum conveyance span where a maximum size sheet, having a maximum width in the longitudinal direction of the heater, is conveyed through the nip, the maximum width being within a width of the belt in an axial direction of the belt, and the second conveyance span includes a minimum conveyance span where a minimum size sheet, having a minimum width in the longitudinal direction of the heater, is conveyed through the nip, the minimum width being within the width of the belt in the axial direction of the belt.

4. The heating device according to claim 1, wherein the first temperature sensor is configured to detect the temperature of the heater.

5. The heating device according to claim 1, wherein the heater is configured to heat the belt directly.

6. The heating device according to claim 1, wherein the heater is configured to not heat the roller directly.

7. The heating device according to claim 6, wherein the first temperature sensor is disposed opposite the roller and is configured to detect the temperature of the roller.

8. The heating device according to claim 6, wherein the second temperature sensor is disposed opposite the roller and is configured to detect the temperature of the roller.

9. The heating device according to claim 1, further comprising a positioner disposed in one lateral end span disposed outboard from a center of the heater in the longitudinal direction of the heater.

10. The heating device according to claim 9, wherein the first temperature sensor is disposed in the one lateral end span.

11. The heating device according to claim 9, wherein the second temperature sensor is disposed in one lateral end span.

12. The heating device according to claim 1, wherein the heater is configured to generate heat in a heat generation span in the longitudinal direction of the heater, and the first temperature sensor and the second temperature sensor are disposed opposite the heater in the heat generation span.

13. An image forming apparatus comprising:

a conveyer configured to convey a sheet; and a heating device configured to heat the sheet, the heating device including:

a belt;

a roller configured to contact the belt to form a nip between the belt and the roller;

a heater configured to generate heat to heat at least one of the belt and the roller;

a first temperature sensor disposed in contact with an outer circumferential surface of the belt and opposite the heater with a gap therebetween, the first temperature sensor configured to detect a temperature of the belt; and a second temperature sensor disposed in contact with the heater or opposite the heater with a gap therebetween, the second temperature sensor configured to detect the temperature of the heater, wherein the first temperature sensor is disposed outside of a first conveyance span in a longitudinal direction of the heater, the first conveyance span being where a first sheet having a first width in the longitudinal direction of the heater is conveyed through the nip, the second temperature sensor is disposed outside of a second conveyance span in the longitudinal direction of the heater, the second conveyance span being where a second sheet having a second width in the longitudinal direction of the heater is conveyed through the nip, the second conveyance span is smaller than and within the first conveyance span, the second width is smaller than the first width, and the second temperature sensor is disposed within the first conveyance span on one side of a center of the first conveyance span and the first temperature sensor is disposed on another side of the center of the first conveyance span.

14. The image forming apparatus according to claim 13, further comprising a shift determiner configured to determine that the first sheet is shifted in a case that the temperature detected by the first temperature sensor is higher than a predetermined temperature.

15. The image forming apparatus according to claim 13, further comprising a non-conveyance span temperature determiner configured to determine that overheating occurs in a non-conveyance span in a case that the temperature detected by the first temperature sensor is higher than a predetermined temperature.

* * * * *